US009139008B2

(12) United States Patent
Komatsu et al.

(10) Patent No.: US 9,139,008 B2
(45) Date of Patent: Sep. 22, 2015

(54) INK FILLING METHOD AND INKJET RECORDING APPARATUS

(71) Applicant: CANON KABUSHIKI KAISHA, Tokyo (JP)

(72) Inventors: Hiroaki Komatsu, Yokohama (JP); Masaya Uetsuki, Yokohama (JP); Toshimitsu Danzuka, Tokyo (JP); Taku Yokozawa, Yokohama (JP); Masataka Kato, Yokohama (JP); Tsuyoshi Ibe, Yokohama (JP); Asako Tomida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/868,842

(22) Filed: Apr. 23, 2013

(65) Prior Publication Data

US 2013/0286063 A1 Oct. 31, 2013

(30) Foreign Application Priority Data

Apr. 26, 2012 (JP) ..... 2012-100962

(51) Int. Cl.

| | |
|---|---|
| ***B41J 29/38*** | (2006.01) |
| ***B41J 2/015*** | (2006.01) |
| ***B41J 2/17*** | (2006.01) |
| ***B41J 2/175*** | (2006.01) |

(52) U.S. Cl.

CPC ..... *B41J 2/175* (2013.01); *B41J 2/17509* (2013.01); *B41J 2/17523* (2013.01); *B41J 2/17553* (2013.01); *B41J 29/38* (2013.01)

(58) Field of Classification Search

CPC ..... B41J 2/175; B41J 2/17566

USPC ..... 347/6, 20, 84–87

See application file for complete search history.

(56) References Cited

U.S. PATENT DOCUMENTS

| | | | | |
|---|---|---|---|---|
| 2002/0024543 | A1* | 2/2002 | Kimura et al. | 347/7 |
| 2007/0252860 | A1 | 11/2007 | Nitta | |
| 2008/0238979 | A1* | 10/2008 | Umeda | 347/17 |
| 2010/0207990 | A1* | 8/2010 | Ito et al. | 347/20 |
| 2010/0231621 | A1 | 9/2010 | Watanabe | |
| 2011/0181670 | A1* | 7/2011 | Tsubaki | 347/85 |

FOREIGN PATENT DOCUMENTS

| | | | |
|---|---|---|---|
| CN | 1533330 | A | 9/2004 |
| CN | 1583411 | A | 2/2005 |
| CN | 102189806 | A | 9/2011 |
| JP | 2009-083387 | A | 4/2009 |
| JP | 2010-208151 | A | 9/2010 |

* cited by examiner

*Primary Examiner* — Jason Uhlenhake

(74) *Attorney, Agent, or Firm* — Canon USA, Inc. IP Division

(57) ABSTRACT

An inkjet recording apparatus includes a recording head including a discharge port, a carriage configured to perform reciprocating scanning with the recording head mounted thereon, a main tank configured to store ink, a sub-tank configured to be supplied with ink from the main tank via a tube, a supply tube configured to connect the recording head and the sub-tank, and a control unit configured to control the carriage, wherein the control unit controls acceleration of the carriage such that a dynamic pressure of ink inside the supply tube becomes greater than a pressure resistance to an ink movement and a pressure resistance to an air movement in the tube.

9 Claims, 16 Drawing Sheets

INK FILLING METHOD AND INKJET RECORDING APPARATUS

BACKGROUND OF THE INVENTION

1. Field of the Invention

Aspects of the present invention generally relate to an ink filling method for filling a sub-tank with ink from a main tank disposed in an inkjet recording apparatus, and an inkjet recording apparatus employing the method.

2. Description of the Related Art

Recently, an ink jet recording apparatus has been used to record various types of images on a large recording medium such as A1 size and A0 size. This type of inkjet recording apparatus generally employs a configuration in which an inkjet recording head (hereinafter referred to as a recording head) mounted on a carriage performing reciprocating scanning in a main scanning direction is connected via a tube to a large-volume main tank (hereinafter referred to a main tank) to supply ink to the recording head.

The large inkjet recording apparatus has a wide range of uses including recording of various types of images from monochrome line drawings to photographic tone images. When the large inkjet recording apparatus records an image having a high printing duty such as a photographic tone image, a large amount of ink is consumed. Although the large-volume main tank is used in the large inkjet recording apparatus, a large amount of ink can be consumed depending on the type of recording image or the volume of printing. The consumption of a large amount of ink causes an increase in frequency of main tank replacement.

When the main tank is connected via the tube to the recording head, a recording operation needs to be stopped to replace the main tank. This decreases the recording efficiency due to a waste of time for replacing the main tank. Moreover, if a recording operation is interrupted in the middle of recording on one recording medium for main tank replacement, the lapse of time causes color unevenness between before and after the interruption and deteriorates image quality.

Accordingly, Japanese Patent Application Laid-Open No. 2010-208151 discusses an inkjet recording apparatus including a sub-tank disposed between a main tank and a recording head so that the main tank can be replaced without interrupting a recording operation. In Japanese Patent Application Laid-Open No. 2010-208151, the main tank is connected to the sub-tank, and ink is moved from the main tank to the sub-tank to fill the sub-tank with the ink. Then, the ink is supplied from the sub-tank to the recording head connected via a tube, so that a recording operation is performed. In such a configuration, even if ink inside the main tank is used up, the inkjet recording apparatus can continue a recording operation using ink stored inside the sub-tank. Thus, the main tank can be replaced while the recording operation is performed using the ink inside the sub-tank. Therefore, the main tank can be replaced without interrupting the recording operation, thereby preventing a decrease in recording efficiency due to a waste of time for replacing the main tank and deterioration in image quality due to a lapse of time.

In Japanese Patent Application Laid-Open No. 2010-208151, a valve capable of blocking an ink supply flow path is disposed in a middle portion of the tube. The tube serves as the ink supply flow path, and connects the sub-tank to the recording head. This valve includes a volume-changeable member (hereinafter referred to as a diaphragm valve), and the operation of this diaphragm valve can cause negative pressure in the sub-tank. When the sub-tank needs to be filled with ink supplied from the main tank, the diaphragm valve is operated to cause the negative pressure in the sub-tank. This negative pressure enables ink to be pulled into the sub-tank from the main tank.

However, when the diaphragm valve disposed between the sub-tank and the recording head is operated to fill the sub-tank with ink, the ink path connecting the sub-tank to the recording head is repeatedly closed and opened. Consequently, ink cannot be supplied to the recording head, and thus the inkjet recording apparatus cannot continue the recording operation. That is, the ink filling operation to the sub-tank cannot be performed along with the recording operation. The recording operation is interrupted during the ink filling to the sub-tank since the ink filling operation needs to be performed independently from the recording operation.

SUMMARY OF THE INVENTION

An aspect of the present invention is generally related to an inkjet recording apparatus capable of performing an ink filling operation to a sub-tank along with a recording operation.

According to an aspect of the present invention, an inkjet recording apparatus includes a recording head including a discharge port, a carriage configured to perform reciprocating scanning with the recording head mounted thereon, a main tank configured to store ink, a sub-tank configured to be supplied with ink from the main tank via a tube, a supply tube configured to connect the recording head and the sub-tank, and a control unit configured to control the carriage, wherein the control unit controls acceleration of the carriage such that a dynamic pressure of ink inside the supply tube becomes greater than a pressure resistance to an ink movement and a pressure resistance to an air movement in the tube.

According to an exemplary embodiment, acceleration of a carriage is controlled and a dynamic pressure generated in a supply tube is used, so that air can be moved from a sub-tank to a main tank via a tube, and ink can be moved from the main tank to the sub-tank. Consequently, the sub-tank can be filled with ink from the main tank without interrupting a recording operation to spare time for an ink filling operation to the sub-tank.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1A:
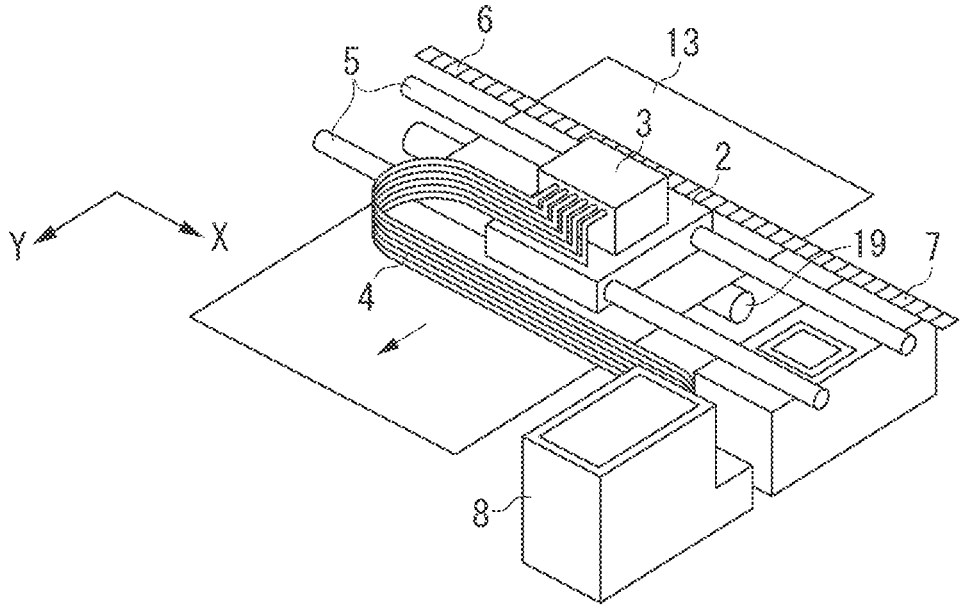
FIG. 1A is a perspective view schematically illustrating an inkjet recording apparatus according to an exemplary embodiment of the present invention.

Various exemplary embodiments, features, and aspects of the invention will be described in detail below with reference to the drawings.

An inkjet recording apparatus can be used to perform a recording operation on a recording medium by discharging ink. Particularly, the inkjet recording apparatus can be applied to devices such as a printer, a copying machine, business equipment such as a facsimile apparatus, and industrial production equipment. The use of such an inkjet recording apparatus enables recording to be performed on various recording media made of paper, thread, fiber, cloth, leather, metal, plastic glass, wood, and ceramic.

The term "recording" used throughout the present specification represents not only a case where a meaningful image such as characters and graphics is provided on a recording medium, but also a case where a meaningless image such as patterns is provided on a recording medium.

Moreover, the term "ink" should be broadly interpreted. The ink is liquid that is provided on a recording medium so that an image, a design, and a pattern are formed, the recording medium is processed, or ink processing or recording medium processing is performed.

Now, an exemplary embodiment will be described with reference to drawings. In the following description, components having substantially the same configuration are given the same reference numerals throughout the drawings, and description thereof may be omitted in some cases.

(Schematic Configuration of Apparatus Body)

Figure 1B:
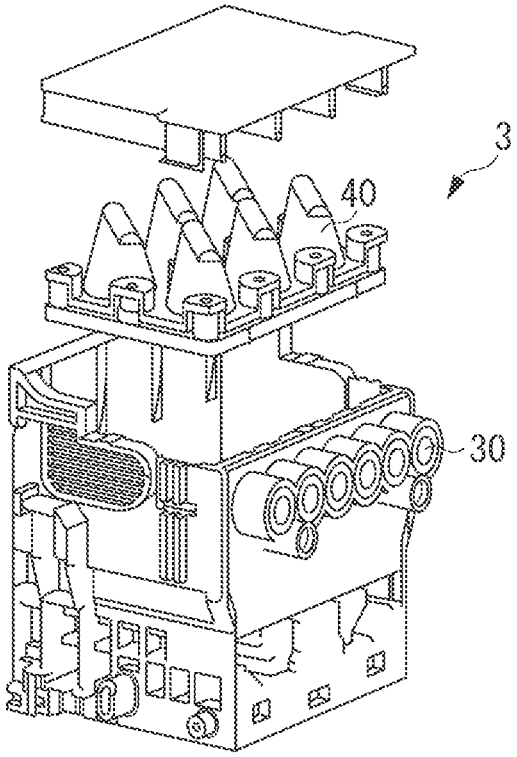
FIG. 1B is an exploded perspective view illustrating one portion of a recording head according to an exemplary embodiment.

FIGS. 1A and 1B are perspective views illustrating a recording apparatus main body of an inkjet recording apparatus performing a recording operation on a recording medium 13. The inkjet recording apparatus in the present exemplary embodiment is a serial-type inkjet recording apparatus that performs a recording operation by causing a recording head to perform reciprocating scanning in a recording width direction of a recording medium. The serial-type inkjet recording apparatus intermittently conveys the recording medium 13 in a direction indicated by an arrow Y in FIG. 1A (a sub-scanning direction) using a conveyance roller 19. With the conveyance of the recording medium 13 in the direction Y, the serial-type inkjet recording apparatus performs a recording operation while causing a recording head 3 mounted on a carriage 2 to perform reciprocating scanning in a direction indicated by an arrow X in FIG. 1A (a main scanning direction). The direction X is perpendicular to the direction Y, which is a conveyance direction of the recording medium 13. A recording apparatus main body illustrated in FIGS. 1A and 1B is, for example, a large inkjet recording apparatus capable of performing recording on a recording medium such as A1 size and A0 size.

The recording head 3 is detachably mounted on the carriage 2, and can discharge supplied ink from a plurality of discharge ports. The carriage 2 performs reciprocating scanning along the direction X illustrated in FIG. 1A with the recording head 3 mounted thereon. Particularly, the carriage 2 is movably supported along guide rails 5 disposed along the direction X, and is fixed to an endless belt 6 moving in parallel with the guide rails 5. The endless belt 6 is moved in a reciprocating manner by drive force of a carriage motor (CR motor), so that the carriage 2 performs reciprocating scanning in the direction X.

An ink supply system 8 includes a plurality of main tanks independently provided for each of color inks. The ink supply system 8 is described in detail with reference to FIG. 3. The ink supply system 8 is connected to the recording head 3 by a plurality of ink supply tubes 4 provided for each of color inks. Each ink supply tube 4 is made of a flexible material. Moreover, the attachment of these main tanks to the ink supply system 8 enables each of color inks stored inside the main tanks to be independently supplied to one of nozzle arrays of the recording head 3. Moreover, in the recording apparatus main body, a recovery processing device 7 is disposed. The recovery processing device 7 recovers and maintains an ink discharge state of the recording head 3.

(Recording Head)

FIG. 1B is an exploded perspective view illustrating one portion of the recording head 3 to be mounted on the carriage 2 of the inkjet recording apparatus. The recording head 3 is supplied with ink from the recording apparatus main body via the ink supply tube 4 by a connection unit 30. The ink supplied by the connection unit 30 is temporarily stored in a reservoir (not illustrated) disposed for each ink color, and discharged when a recording operation is performed. A pressure adjustment member 40 including an elastically deformable rubber member is connected to the reservoir. A change in volume of the pressure adjustment member 40 can adjust the pressure inside the reservoir. Particularly, the pressure adjustment member 40 has a volume of approximately 1.4 ml, and can allow a volume change of approximately ±0.3 ml.

(Control System)

Figure 2:
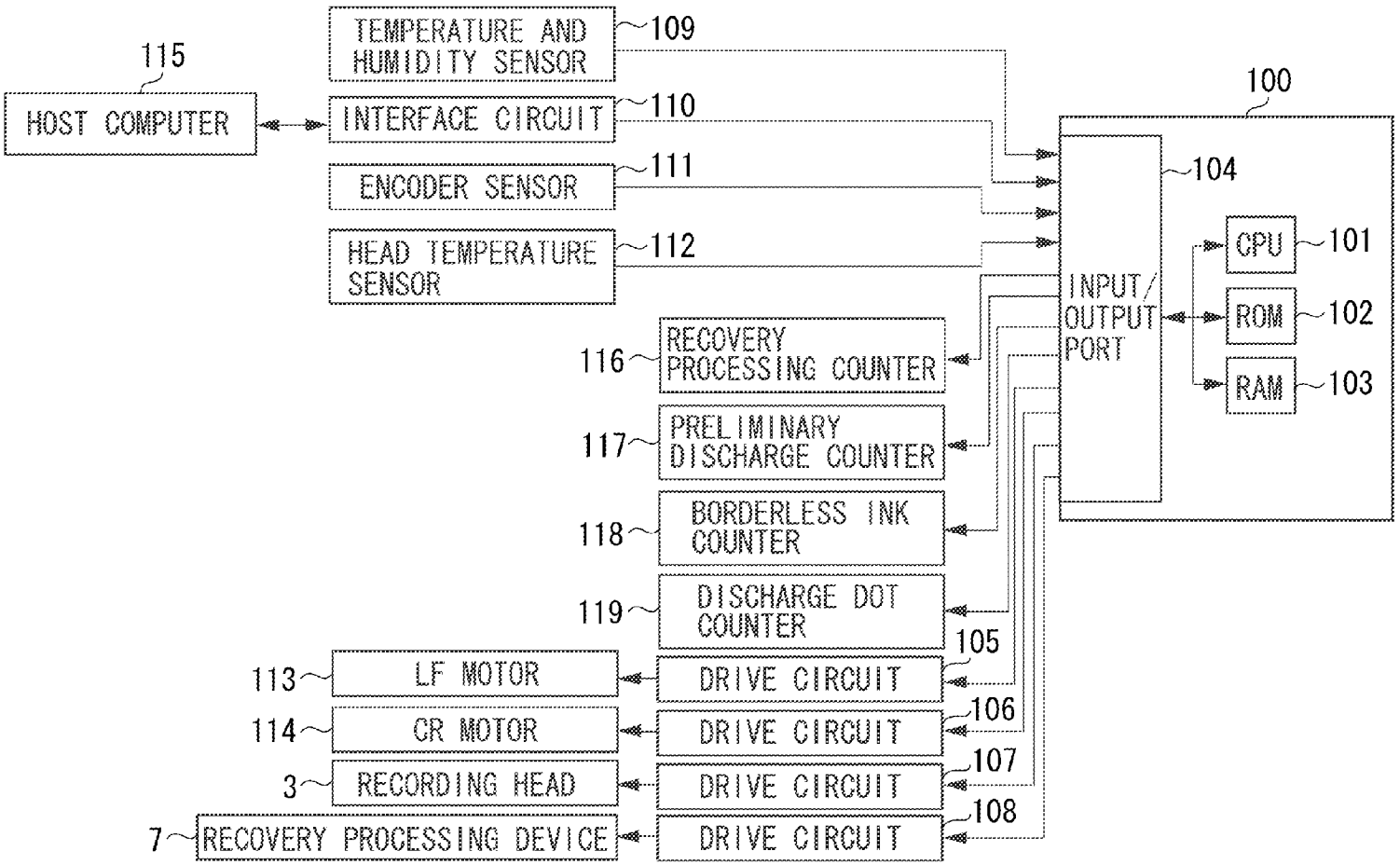
FIG. 2 is a block diagram schematically illustrating a configuration of a control system mounted on an inkjet recording apparatus main body.

FIG. 2 is a block diagram illustrating a configuration example of a control system (a control unit) mounted on the recording apparatus main body of the inkjet recording apparatus according to the present exemplary embodiment. In FIG. 2, a main control unit 100 includes a central processing unit (CPU) 101 for executing various processing operations such as calculation, control, determination, and settings. Moreover, the main control unit 100 includes a read only memory (ROM) 102, a random access memory (RAM) 103, and an input/output port 104. The ROM 102 stores control programs to be executed by the CPU 101. The RAM 103 is used as a buffer storing binary recording data indicating discharge/non-discharge of ink, and used as a work area of processing executed by the CPU 101.

The input/output port 104 is connected to drive circuits 105, 106, 107, and 108 respectively provided for a conveyance motor (LF motor) 113 for driving a conveyance roller, a carriage motor (CR motor) 114, the recording head 3, and the recovery processing device 7. Each of these drive circuits 105, 106, 107, and 108 is controlled by the main control unit 100. The input/output port 104 is connected to various sensors such as a head temperature sensor 112, an encoder sensor 111 fixed to the carriage 2, and a temperature and humidity sensor 109. The head temperature sensor 112 detects temperature of the recording head 3, and the temperature and humidity sensor 109 detects temperature and humidity in the usage environment of the recording apparatus main body. The main control unit 100 is connected to a host computer 115 via an interface circuit 110.

A recovery processing counter 116 counts the amount of ink forcibly discharged from the recording head 3 by the recovery processing device 7. A preliminary discharge counter 117 counts the amount of ink preliminarily discharged before a recording operation is started, when a recording operation is finished, or during a recording operation. A borderless ink counter 118 counts the amount of ink recorded outside the area of a recording medium when borderless recording is performed. A discharge dot counter 119 counts the amount of ink discharged during a recording operation.

A recording operation executed by the inkjet recording apparatus with such a configuration is now described. When the inkjet recording apparatus receives recording data from the host computer 115 via the interface circuit 110, the recording data is loaded into a buffer of the RAM 103. When a recording operation is instructed, the conveyance roller 19 operates to convey a recording medium 13 to a position facing the recording head 3. The carriage 2 moves along the guide rails 5 in the direction X illustrated in FIG. 1A. With the movement of the carriage 2, ink droplets are discharged from the recording head 3, and one band of an image is recorded on the recording medium 13. Subsequently, the recording medium 13 is conveyed for one band in the direction Y perpendicular to the carriage 2 by a conveyance unit. Such an operation is repeated, so that a predetermined image is formed on the recording medium 13.

A position of the carriage 2 is detected by counting a pulse signal by the main control unit 100, the pulse signal being output from the encoder sensor 111 with the movement of the carriage 2. That is, the encoder sensor 111 outputs a pulse signal to the main control unit 100 upon detection of each of detection portions arranged with a predetermined distance therebetween on an encoder film (not illustrated) placed along the direction X. The main control unit 100 counts these pulse signals, thereby detecting the position of the carriage 2. The carriage 2 moves to a home position or other positions based on the signals from the encoder sensor 111.

(Ink Supply System)

Figure 3:
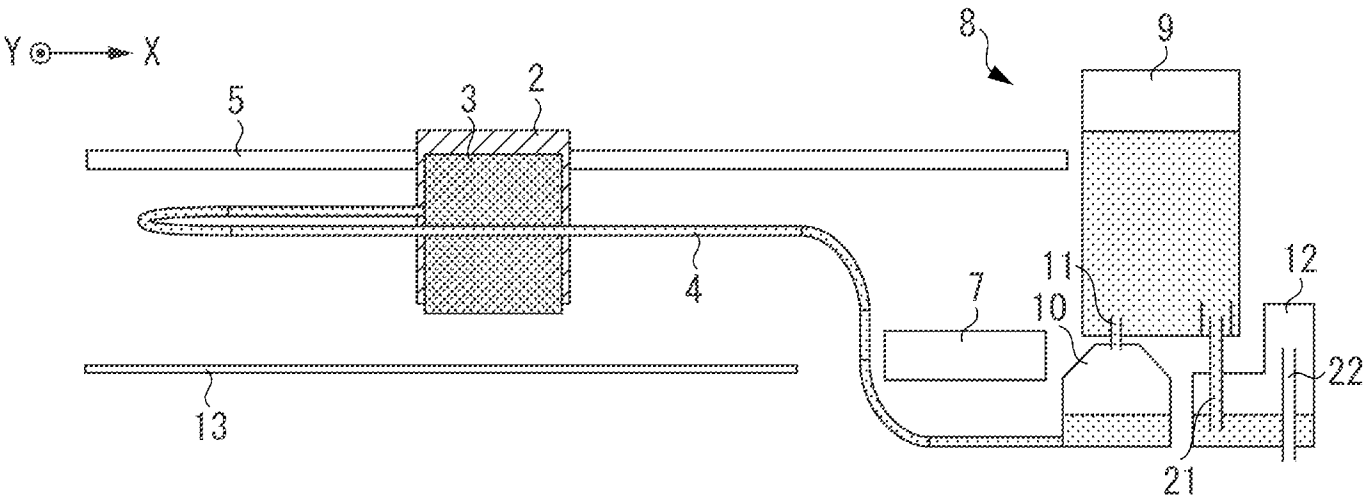
FIG. 3 is a schematic diagram illustrating an ink supply system.

FIG. 3 is a schematic diagram illustrating a configuration of an ink supply system of the inkjet recording apparatus according to the present exemplary embodiment. That is, FIG. 3 schematically illustrates the ink supply system 8, the recording head 3, and the supply tube 4 connecting the ink supply system 8 and the recording head 3. Herein, one supply tube 4 is illustrated for the sake of simplicity.

In FIG. 3, the ink supply system 8 is disposed in a predetermined position in the recording apparatus main body. The ink supply system 8 includes a main tank 9, a sub-tank 10, a hollow tube 11 for connecting the main tank 10 and the sub-tank 9, a buffer chamber 12, and a communication tube 21 for connecting the main tank 9 and the buffer chamber 12. The supply tube 4 made of a flexible material connects the sub-tank 10 and the recording head 3. In the example illustrated in FIG. 3, the ink supply system 8 is disposed on the right side. The supply tube 4 connected to the sub-tank 10 has a portion parallel to a moving/scanning direction of the carriage 2. As illustrated in FIG. 3, the supply tube 4 extends inside the recording apparatus main body such that the supply tube 4 is connected to a left side of the recording head 3 by being folded back in a middle portion thereof. That is, the supply tube 4 is arranged to include a portion parallel to the guide rails 5. The arrangement of the supply tube 4 illustrated in FIG. 3 is merely one example, and is not limited thereto.

Next, a configuration of the ink supply system 8 is described.

The main tank 9 is detachably mounted on the recording apparatus main body. In the inkjet recording apparatus according to the present exemplary embodiment, the main tank 9 stores a greater volume of ink than the sub-tank 10. Moreover, the main tank 9 communicates with the sub-tank 10 via the hollow tube 11, and communicates with the buffer chamber 12 via the communication tube 21. The main tank 9 is connected to the hollow tube 11 and the buffer chamber 12 at the bottom thereof when the main tank 9 is attached to the recording apparatus main body. The main tank 9 is hermetically closed except for these connection portions.

The sub-tank 10 is disposed in a lower position than that of the recording head 3 in the direction of gravity. The sub-tank 10 includes a ceiling portion formed in a dome shape or with an inclined surface, and the hollow tube 11 is connected to an upper portion of the sub-tank 10 in the direction of gravity. In FIG. 3, the hollow tube 11 is connected to a position, which is an uppermost portion of the sub-tank 10, and has an intrusion amount of substantially 0 mm with respect to the sub-tank 10.

When an end portion of the hollow tube 11 is in a position not in contact with ink inside the sub-tank 10, dynamic pressure of ink inside the supply tube 4 is used to fill the sub-tank 10 with the ink. That is, since a position of the hollow tube 11 inside the sub-tank 10 becomes an ink position at the time of completion of filling the sub-tank 10 with the ink by using dynamic pressure, an appropriate adjustment in the intrusion amount of the hollow tube 11 can control an amount of ink filled by using the dynamic pressure. A position of the hollow tube 11 can be set so that the sub-tank 10 is desirably filled with an amount of ink greater than or equal to that which enables the inkjet recording apparatus to continue a recording operation for at least one sheet of a large recording medium even during replacement of the main tank 9.

Moreover, the sub-tank 10 communicates with the supply tube 4 communicating with the recording head 3 in a lower portion thereof (near the bottom), that is, the sub-tank 10 communicates with the supply tube 4 in a position always in contact with ink. Substantially, the sub-tank 10 is hermetically closed except for the connection portions to the hollow tube 11 and the supply tube 4. As long as the sub-tank 10 is substantially closed in a hermetic manner during the filling of the sub-tank 10 with ink, the sub-tank 10 may not necessarily be hermetically closed at a time other than the time of the ink filling to the sub-tank 10. Even during the filling of the sub-tank 10 with ink, the sub-tank 10 may have a communication location having a higher pressure resistance than an ink movement pressure resistance Pi and an air movement pressure resistance Pa described below.

In the hollow tube 11, ink and air can be moved depending on the internal pressure inside the sub-tank 10. However, the ink does not move spontaneously from the main tank 9 to the sub-tank 10 by gravity. For example, the hollow tube 11 has an inner diameter large enough to have flow path resistance that allows the ink to be moved smoothly. At the same time, the hollow tube 11 has an inner diameter large enough (e.g., an inner diameter of 1 to 2 mm) for the ink to have meniscus in an opening thereof.

The buffer chamber 12 is connected to the main tank 9 via the communication tube 21, and the communication tube 21 extends to near the bottom of the buffer chamber 12. Moreover, the buffer chamber 12 includes an atmosphere communication tube 22 for releasing (communicating with) the air, while the buffer chamber 12 is connected to the main tank 9 via the communication tube 21. One end of the atmosphere communication tube 22 is arranged in an upper portion inside the buffer chamber 12, and the other end is arranged outside buffer chamber 12. This arrangement maintains a balance between internal pressure of the main tank 9 and atmospheric pressure. The buffer chamber 12 functions as a space for storing the ink moved from the main tank 9, owing to changes in external environments. FIG. 3 illustrates a state in which there is some ink in the buffer chamber 12, and the communication tube 21 connected to the main tank 9 is filled with ink while one of the ends of the communication tube 21 is positioned inside the ink. This illustrates a state in which the ink is moved from the main tank 9 to the buffer chamber 12. Even in such a state, a shape of the buffer chamber 12 and an arrangement of the atmosphere communication tube 22 can be appropriately selected to maintain communication between the inside of the buffer chamber 12 and the atmosphere. Therefore, the ink supply system 8 is formed by communicating the main tank 9, the sub-tank 10, the buffer chamber 12, and the recording head 3.

Next, a description is given of a case where a recording operation causes the sub-tank 10 to be filled with ink.

When a recording operation is executed, ink is discharged from a discharge port of the recording head 3 and consumed. Accordingly, the pressure inside the sub-tank 10 becomes negative via the supply tube 4. When this negative pressure exceeds the flow path resistance and the meniscus pressure-resistance of the hollow tube 11, the ink is supplied from the main tank 9 to the sub-tank 10. That is, the amount of ink inside the main tank 9 is decreased by the amount of ink consumed by the recording operation.

When the supply of ink causes the pressure inside the main tank 9 to be negative, and there is no ink inside the buffer chamber 12, the atmosphere is introduced into the main tank 9 via the communication tube 21 and the buffer chamber 12 communicates with the atmosphere via the atmosphere communication tube 22, thereby eliminating the negative pressure.

When the buffer chamber 12 has ink thereinside and the communication tube 21 communicates with the ink as illustrated in FIG. 3, the ink inside the buffer chamber 12 returns to the main tank 9 via the communication tube 21, thereby eliminating the negative pressure inside the main tank 9.

If the inkjet recording apparatus continues a recording operation, the ink stored in the main tank 9 is eventually used up, and replacement of the main tank 9 becomes necessary. The inkjet recording apparatus is formed such that a predetermined amount of ink can be stored beforehand in the sub-tank 10, so that that the inkjet recording apparatus can continue a recording operation even during the replacement of the main tank 9. This ink can be used to perform a temporary recording operation. The predetermined amount of ink inside the sub-tank 10 is set to an amount (approximately 30 ml in the present exemplary embodiment) which enables the inkjet recording apparatus to continue the recording operation for at least one sheet of a large recording medium (e.g., A1 size). Therefore, the main tank 9 can be replaced without interrupting the recording operation on at least one sheet. Alternatively, the sub-tank 10 may have a volume capable of storing a necessary ink amount in consideration of recording time and time necessary to perform a replacement operation.

After the ink stored in the main tank 9 is used up, and then the ink stored in the sub-tank 10 is consumed for the recording operation, the ink inside the sub-tank 10 becomes below the predetermined amount. Accordingly, after the main tank 9 is replaced, ink filling to the sub-tank 10 with the ink from the main tank 9 becomes necessary.

Such a method for filling a sub-tank with ink is discussed in Japanese Patent Application Laid-Open No. 2010-208151 as a conventional method by which a diaphragm valve disposed between a main tank and a recording head is opened and closed. According to this method, however, a recording operation cannot be performed during ink filling to a sub-tank.

In the present exemplary embodiment, dynamic pressure inside the supply tube 4 is used to control acceleration of the carriage 2 such that the sub-tank 10 is filled with ink. Such acceleration of the carriage 2 can be generated during a recording operation. Consequently, the acceleration of the carriage 2 during the recording operation is controlled, so that the sub-tank 10 can be gradually filled with ink even without making time for an ink filling operation to the sub-tank 10.

When the recording apparatus main body is initially installed, any of the recording head 3, the supply tube 4, and the sub-tank 10 do not have ink thereinside. Thus, the recording head 3 and the supply tube 4 need to be filled with ink before the ink filling by using dynamic pressure of the ink inside the supply tube 4 is performed according to the present exemplary embodiment. A method for initially filling the recording head 3, the supply tube 4, and the sub-tank 10 with ink can include a method for suctioning ink by the recovery processing device 7 connected to a pump (not illustrated) into a discharge port (not illustrated) of the recording head 3. After ink is stored in the recording head 3 and the supply tube 4 by this method, the ink filling by using dynamic pressure of the ink inside the supply tube 4 of the present exemplary embodiment can be performed.

Now, a method for filling the sub-tank 10 with ink by controlling acceleration of the carriage 2 is described in detail.

Figure 4A:
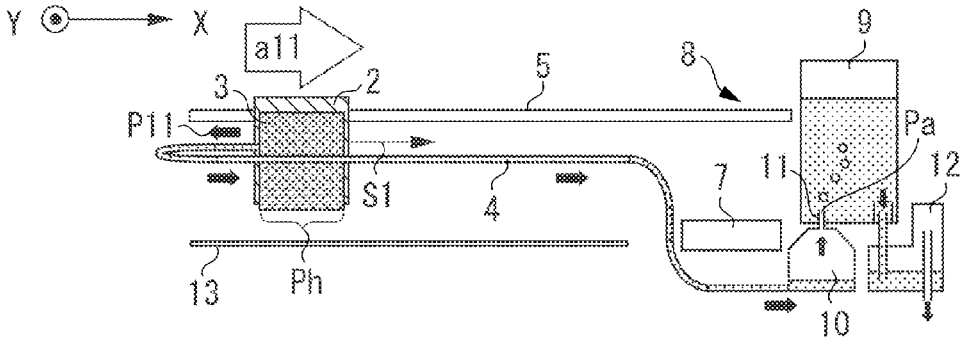
FIGS. 4A, 4B, 4C, 4D, 4E, and 4F are schematic diagrams illustrating a sequence of ink filling into a sub-tank when reciprocating scanning is performed during a recording operation according to a first exemplary embodiment.
Figure 4B:
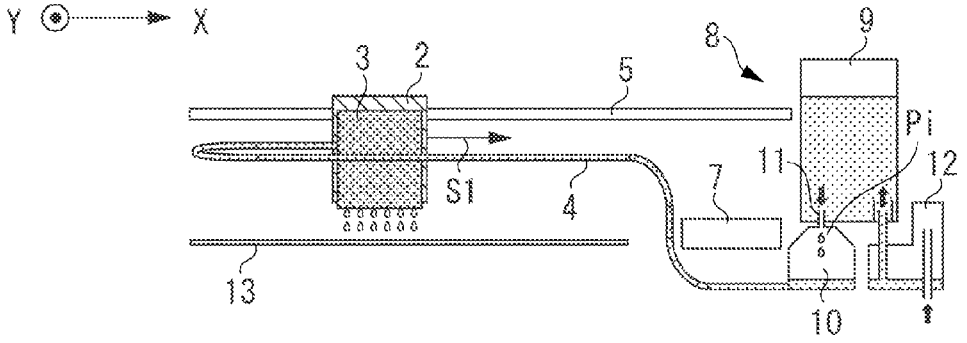
Figure 4C:
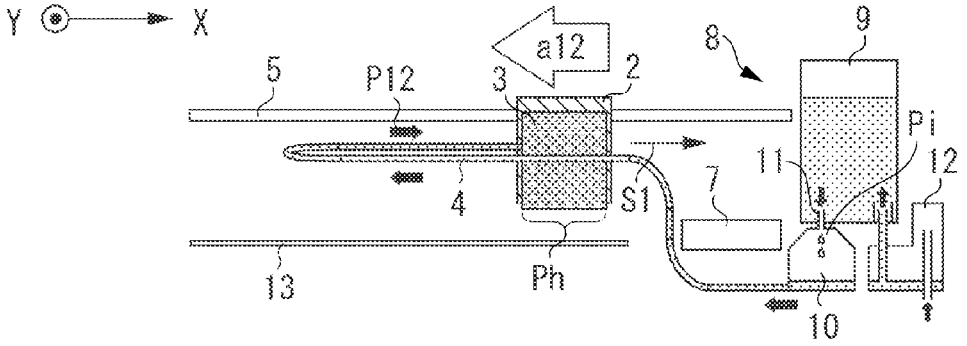
Figure 4D:
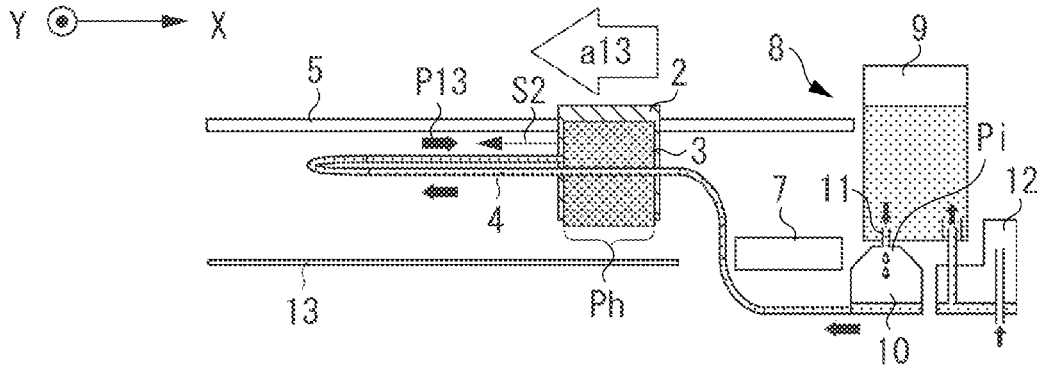
Figure 4E:
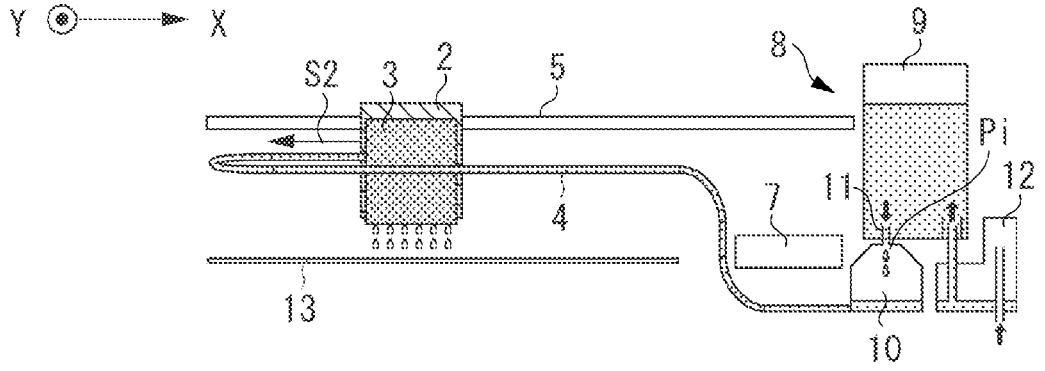
Figure 4F:
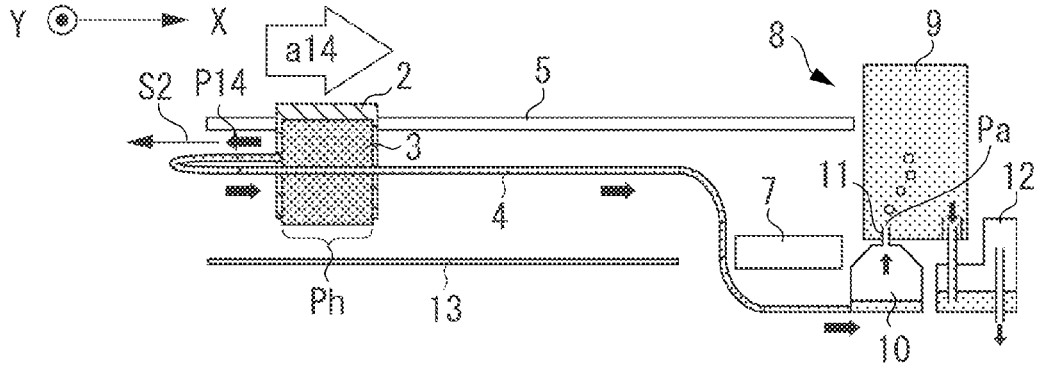

FIGS. 4A, 4B, 4C, 4D, 4E, and 4F are schematic diagrams illustrating operations performed when the sub-tank 10 is filled with ink by using dynamic pressure of the ink inside the supply tube 4 with a movement of the carriage 2 by scanning in a forward direction and a backward direction according to the first exemplary embodiment. One reciprocating movement of the carriage 2 is illustrated with FIGS. 4A, 4B, 4C, 4D, 4E, and 4F in chronological order. Moreover, movement directions of the carriage 2 are indicated by arrows S1 and S2. Each of FIGS. 4A, 4B, and 4C illustrates a movement of the carriage 2 in the direction S1, whereas each of FIGS. 4D, 4E, and 4F illustrates a movement of the carriage 2 in the direction S2.

In FIGS. 4A through 4F, dynamic pressures P11, P12, P13, and P14 act on the ink inside the supply tube 4 by accelerations a11, a12, a13, and a14, respectively. Moreover, a pressure resistance Pi to an ink movement inside the hollow tube 11, the pressure resistance Pa to an air movement inside the hollow tube 11, and a meniscus pressure-resistance Ph in a discharge port (not illustrated) of the recording head 3 are applied.

First, a movement of the air from the sub-tank 10 to the main tank 9 is described with reference to FIG. 4A.

The carriage 2 holding the recording head 3 is controlled by a control system (see FIG. 2) mounted on the inkjet recording apparatus main body such that the carriage 2 accelerates in the direction S1 with the acceleration a11. The supply tube 4 connected to the recording head 3 includes a section which moves by following a movement of the carriage 2. Herein, within the supply tube 4, the ink in the section, which moves by following the movement of the carriage 2, receives an inertial force generated by the acceleration a11. Since the supply tube 4 is arranged in parallel to the movement direction of the carriage 2, the ink having received the inertial force generated by the acceleration a11 is moved from the supply tube 4 to the sub-tank 10. The pressure generated at this time is the dynamic pressure P11 that acts on the ink inside the supply tube 4 with the acceleration a11.

Subsequently, the ink having received the dynamic pressure P11 is moved from the inside of the supply tube 4 to the sub-tank 10, thereby applying pressure to the inside of the sub-tank 10.

There is an air layer in an upper portion inside the sub-tank 10, and the air layer contacts the hollow tube 11. Herein, in a connection edge of the hollow tube 11 inside the main tank 9, the flow path resistance and the meniscus pressure-resistance are generated as the pressure resistance Pa to an air movement. That is, if the dynamic pressure P11 is higher than this pressure resistance Pa, the air is moved from the sub-tank 10 to the main tank 9. If the inside of the main tank 9 becomes pressurized by the air movement, the ink inside the main tank 9 is moved to the buffer chamber 12 via the communication tube 21. When the ink is moved into the buffer chamber 12, the air inside the buffer chamber 12 is pushed out via the atmosphere communication tube 22.

Moreover, the dynamic pressure P11 causes the ink to flow out from a reservoir of the recording head 3. The pressure generated at this time is adjusted by the pressure adjustment member 40. Since there is a limit that the pressure adjustment member 40 can adjust the amount of fluctuations, the dynamic pressure P11 may be desirably controlled to be lower than the meniscus pressure-resistance Ph in the discharge port of the recording head 3. Such control can prevent an inflow of the air from the discharge port of the recording head 3 to the inside of the recording head 3.

That is, the acceleration a11 is applied such that the dynamic pressure P11 (expressed as P1 in the below relational expression) of the ink inside the supply tube 4 becomes higher than the pressure resistance Pa to the air movement of the hollow tube 11 (P1>Pa). The application of such the acceleration a11 enables the air to be moved from the sub-tank 10 to the main tank 9. Moreover, if the acceleration a11 is set such that the dynamic pressure P11 is lower than the meniscus pressure-resistance Ph in the discharge port of the recording head 3 (see Expression (1)), the inflow of the air from the discharge port can be prevented.

$$Ph > P1 > Pa \qquad \text{Expression (1)}$$

FIG. 4B illustrates a state in which the carriage 2 reaches a predetermined speed (e.g., 25 inches/second) from the state illustrated in FIG. 4A, and moves in the direction S1 at a constant speed. During the movement at the constant speed, the pressure is not changed by the movement of the carriage 2, and the ink is not moved by the change of the dynamic pressure. In the state illustrated in FIG. 4B, ink of the amount corresponding to the amount of ink discharged from the recording head 3 by executing the recording operation is only moved from the main tank 9 to the sub-tank 10. An operation for pulling the air or ink may be performed, in response to states of the buffer chamber 12 and the communication tube 21, depending on negative pressure inside the main tank 9. Accordingly, the ink can continue to be supplied, and the recording operation is performed in the direction S1 according to a recording signal.

Next, a movement of the ink from the main tank 9 to the sub-tank 10 is described with reference to FIG. 4C. In the predetermined section as illustrated in FIG. 4B, the carriage 2 is moved in the direction S1 at the constant speed for the recording operation. Subsequently, the carriage 2 holding the recording head 3 is controlled by the control system (see FIG. 2) mounted on the recording apparatus main body such that the carriage 2 decelerates with a minus acceleration a12.

In the deceleration section, the ink inside the supply tube 4 receives an inertial force generated by the minus acceleration a12. Since the supply tube 4 is arranged in parallel to the movement direction of the carriage 2, the ink having received the inertial force is moved from the supply tube 4 toward a direction of the recording head 3. The pressure generated at this time is the dynamic pressure P12 to be applied to the ink inside the supply tube 4 by the acceleration a12.

The ink having received the dynamic pressure P12 is moved from the supply tube 4 to the recording head 3, and this movement reduces the pressure inside the sub-tank 10.

In the hollow tube 11, the flow path resistance and the meniscus pressure-resistance are generated as the pressure resistance Pi to an ink movement. Accordingly, when the dynamic pressure P12 becomes higher than this pressure resistance Pi, the ink is moved from the main tank 9 to the sub-tank 10. Herein, the inside of the main tank 9 is negatively pressurized. Consequently, if there is ink inside the communication tube 21 and the buffer chamber 12 as illustrated in FIG. 4C, the ink inside the buffer chamber 12 is pulled into the main tank 9 via the communication tube 21. On the other hand, if there is not ink inside the communication tube 21 or the buffer chamber 12, the air is pulled inside the 9 via the atmosphere communication tube 22, the buffer chamber 12, and the communication tube 21.

Moreover, the ink moved to the recording head 3 by the dynamic pressure P12 flows into the reservoir inside the recording head 3. The pressure generated at this time is adjusted by the pressure adjustment member 40. Since there is a limit that the pressure adjustment member 40 can adjust the amount of fluctuations, the dynamic pressure P12 may be desirably controlled to be lower than the meniscus pressure-resistance Ph in the discharge port of the recording head 3. Such control can prevent leakage of the ink from the discharge port of the recording head 3.

That is, the acceleration a12 is applied such that the dynamic pressure P12 (expressed as P2 in the relational expression below) of the ink inside the supply tube 4 becomes higher than the pressure resistance Pi to the ink movement of the hollow tube 11 (P2>Pi). The application of the acceleration a12 enables the ink to be moved from the main tank 9 to the sub-tank 10. Moreover, if the acceleration a12 is set such that the dynamic pressure P12 is lower than the meniscus pressure-resistance Ph in the discharge port of the recording head 3 (see Expression (2)), leakage of the ink from the discharge port can be prevented.

$$Ph>P2>Pi \quad \text{Expression (2)}$$

When decelerating with the acceleration a12, the carriage 2 gradually reduces speed and becomes motionless. Then, the carriage 2 begins to move in the direction S2. FIG. 4D illustrates the state of acceleration of the carriage 2 in the direction S2. Herein, a direction of the acceleration a13 is the same as that of the acceleration a12, and the ink dynamic pressure P13 (expressed as P2 in the relational expression below) acts on the ink inside the tube. Since a pressure resistance relation at this time satisfies the same relational expression as FIG. 4C, the ink is moved from the main tank 9 to the sub-tank 10 similar to the state illustrated in FIG. 4C.

FIG. 4E illustrates a state in which the carriage 2 moves in the direction S2 at a constant moving speed (e.g., 25 inches/second) from the state illustrated in FIG. 4D. Similar to the state illustrated in FIG. 4B, a recording operation in the direction S2 is performed by discharging ink to the recording medium 13 during the movement of the carriage 2 at this constant speed.

After performing the recording operation during the movement at the constant speed in the predetermined section, the carriage 2 decelerates with the acceleration a14 as illustrated in FIG. 4F. Herein, a direction of the acceleration a14 is the same as that of the acceleration a11, and the dynamic pressure P14 (expressed as P1 in the relational expression) acts on the ink inside the tube. At this time, a pressure resistance relation satisfies the same relational expression as that of FIG. 4A. That is, the air is moved from the sub-tank 10 to the main tank 9 similar to the state illustrated in FIG. 4A.

Thus, the carriage 2 repeatedly performs the scanning in the forward direction and the backward direction, so that the sub-tank 10 is filled with the ink by using the dynamic pressure in the acceleration and deceleration area, particularly illustrated in FIGS. 4C and 4D.

One example configuration of the recording apparatus main body for such operations is as follows.

The sub-tank 10 has a volume of approximately 30 ml. The communication tube 21 has an inner diameter of approximately 1 mmϕ to 2 mmϕ and a length of approximately 25 mm to 30 mm. The communication tube 21 has an intrusion amount of substantially 0 mm into the inside of the sub-tank 10, and an intrusion amount of approximately 2.5 mm into the inside of the main tank 9. The supply tube 4 has an inner diameter of approximately 2 mmϕ to 2.5 mmϕ, and a length of approximately 650 mm to 1000 mm. The discharge port of the recording head 3 has a meniscus pressure-resistance with a negative pressure of approximately 5 kPa to 10 kPa.

Figure 5A:
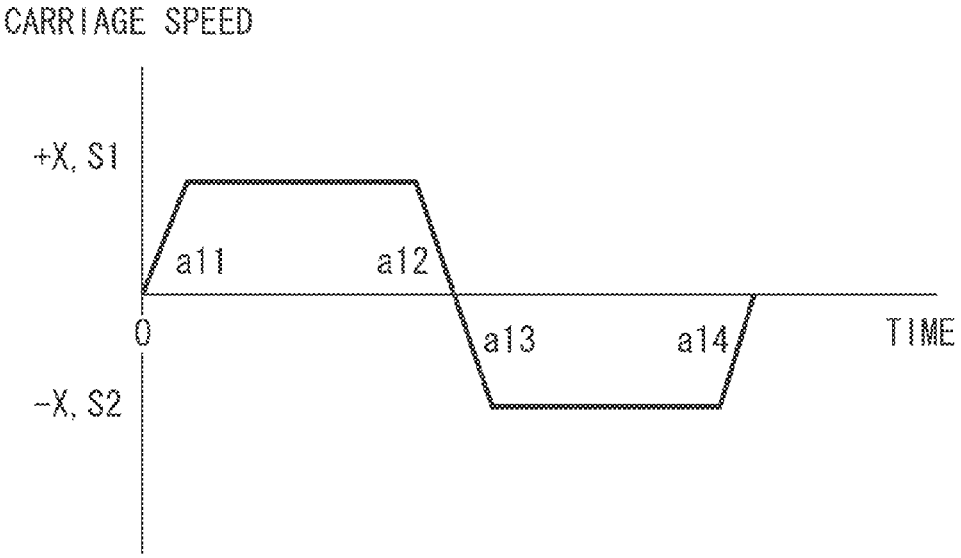
FIG. 5A is a schematic diagram illustrating an example of moving speed of a carriage when reciprocating scanning is performed during a recording operation according to the first exemplary embodiment.
Figure 5B:
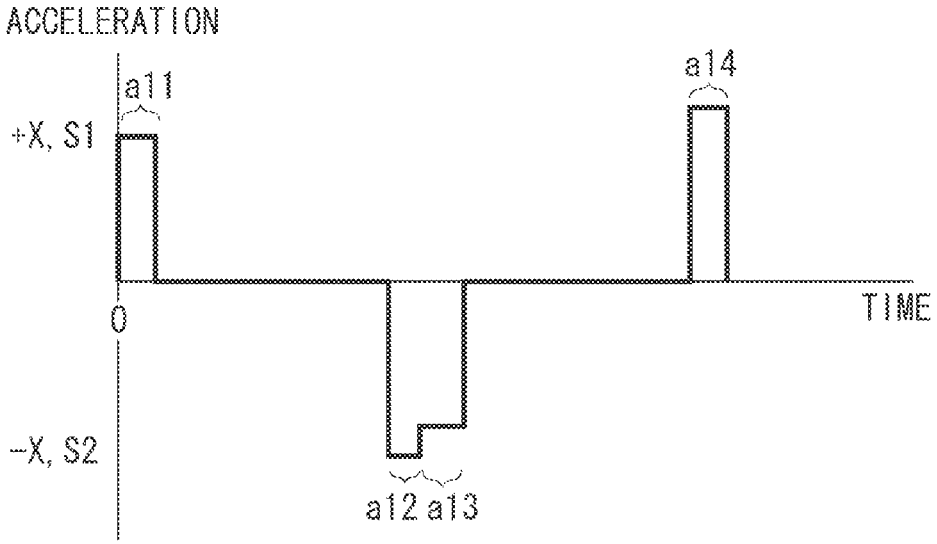
FIG. 5B is a schematic diagram illustrating an example of an acceleration profile when reciprocating scanning is performed during a recording operation.

FIGS. 5A and 5B respectively illustrate an example of carriage speed and an example of acceleration profile of the carriage 2 in an ink filling operation to the sub-tank 10 during reciprocating scanning (also referred to as bidirectional recording). Assume that the direction S1 in each of FIGS. 4A, 4B, and 4C (a direction substantially the same as a direction indicated by an arrow X in each of FIGS. 4A, 4B, and 4C can be expressed as a plus X direction) is set to plus. The direction S2 in each of FIGS. 4D, 4E, and 4F (a direction opposite to a direction indicated by an arrow X in FIGS. 4D, 4E, and 4F can be expressed as a minus X direction) is set to minus.

As described with reference to FIGS. 4A through 4F, the carriage scanning section of the recording apparatus has the acceleration/deceleration section and the constant speed section. The acceleration/deceleration section contributes to filling of the sub-tank 10 with ink. The recording apparatus in the present exemplary embodiment has the carriage scanning section of approximately 36 inches. However, the carriage scanning section is not limited thereto as long as the carriage 2 can perform scanning with the acceleration that generates the dynamic pressure having a predetermined relation in the acceleration/deceleration section.

In FIG. 5A, a horizontal axis indicates time, and a vertical axis indicates moving speed of the carriage 2. In FIG. 5B, a horizontal axis indicates time, and a vertical axis indicates acceleration of the carriage 2. In FIG. 5A, the carriage 2 is motionless at time 0. The carriage 2 begins to move in the direction S1 at the acceleration a11 (e.g., 200 inches/second$^2$). After moving for a predetermined time, the carriage 2 reaches a predetermined speed (e.g., 25 inches/second) and moves at a constant speed. After moving further for a predetermined time, the carriage 2 decelerates with the acceleration a12 (e.g., 230 inches/second$^2$), and eventually becomes motionless. Subsequently, the carriage 2 begins to move in the direction S2 at the acceleration a13 (e.g., 200 inches/second$^2$). After moving for a predetermined time, the carriage 2 reaches a predetermined speed (e.g., 25 inches/second) and moves at a constant speed. After moving further for a predetermined time, the carriage 2 decelerates with the acceleration a14 (e.g., 230 inches/second$^2$), and eventually becomes motionless.

More particularly, the dynamic pressure of the ink inside the supply tube 4 can be expressed as follows.

$$P_n=(m_n \cdot a_n)/S \quad \text{Expression (3)}$$

$m_n$: mass of the ink to undergo acceleration
S: cross-sectional area of the supply tube 4
$a_n$: acceleration of the carriage 2

Moreover, a mass of the ink at the time when maximum dynamic pressure is generated is expressed as follows.

$$m_n=kSL_n \quad \text{Expression (4)}$$

k: specific gravity of the ink
S: cross-sectional area of the supply tube 4
$L_n$: maximum length of the supply tube 4 to undergo inertia from acceleration Substitution of Expression (4) into Expression (3) yields the following relation.

$$Pn=kL_n a_n \quad \text{Expression (5)}$$

That is, Ph>P1>Pa of Expression (1) and Ph>P2>Pi of Expression (2) can be converted into $Ph/(kL_1)>a_1>Pa/(kL_1)$ and $Ph/(kL_2)>a_2>Pi/(kL_2)$, respectively.

Thus, the carriage 2 during the recording operation is controlled to accelerate at acceleration satisfying the above relations, so that the sub-tank 10 can be filled with ink from the main tank 9 by using ink dynamic pressure generated in the supply tube 4. Consequently, the sub-tank 10 can be reliably filled with ink without interrupting a recording operation to spare time for an ink filling operation to the sub-tank 10.

When the sub-tank 10 is filled with a sufficient amount of ink in a state as illustrated in FIGS. 4A and 4F, the ink instead of the air is moved from the sub-tank 10 to the main tank 9 via the hollow tube 11. Thus, the ink filling operation to the sub-tank 10 using the dynamic pressure is not performed.

Moreover, the present exemplary embodiment is not provided to restrict time for generating acceleration, and these drawings are merely examples. Moreover, in the example case described in the present exemplary embodiment, air is first moved and then ink is moved. However, such a case is merely one example. Alternatively, ink may be moved first, and then air may be moved.

In the first exemplary embodiment, a sub-tank is filled with ink by using dynamic pressure generated when reciprocating scanning is performed during a recording operation. In a second exemplary embodiment, a sub-tank is filled with ink by using dynamic pressure generated during unidirectional recording.

Figure 6A:
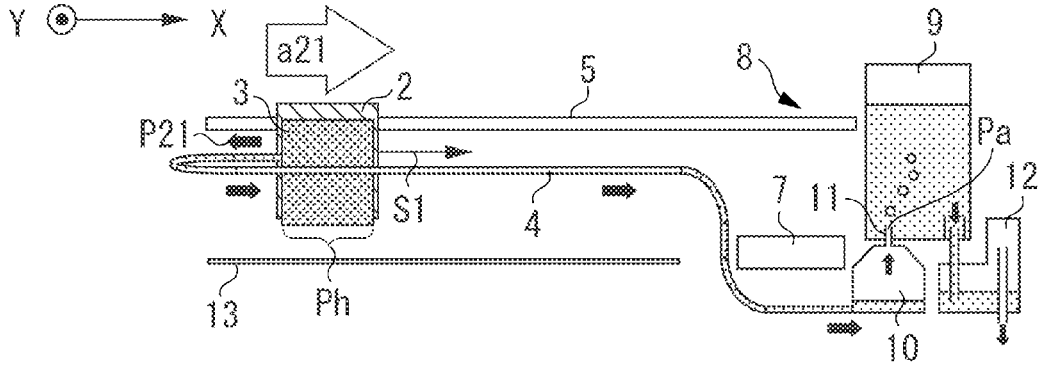
FIGS. 6A, 6B, 6C, 6D, and 6E are schematic diagrams illustrating a sequence of ink filling into a sub-tank during unidirectional recording according to a second exemplary embodiment.
Figure 6B:
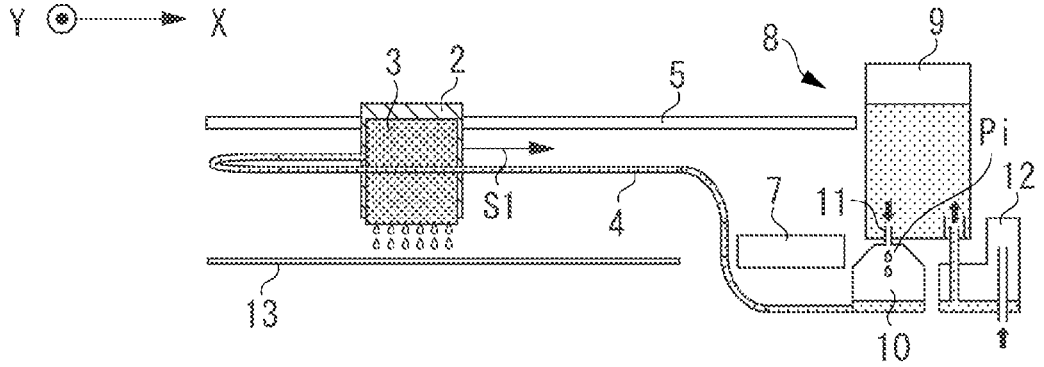
Figure 6C:
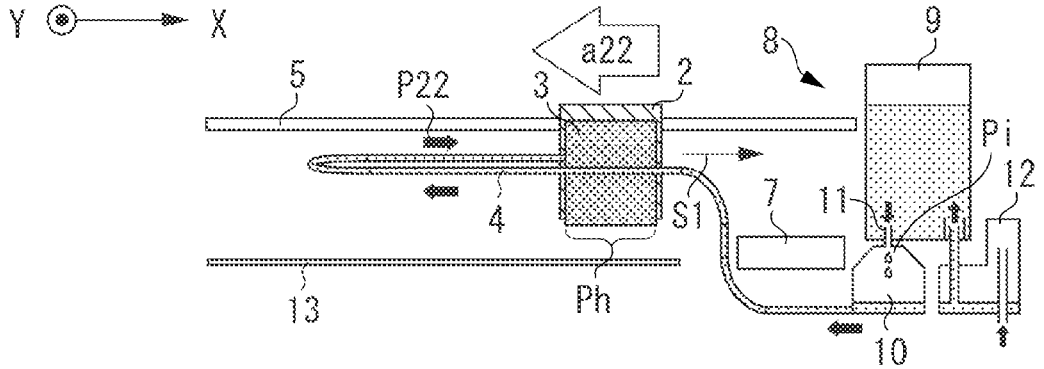
Figure 6D:
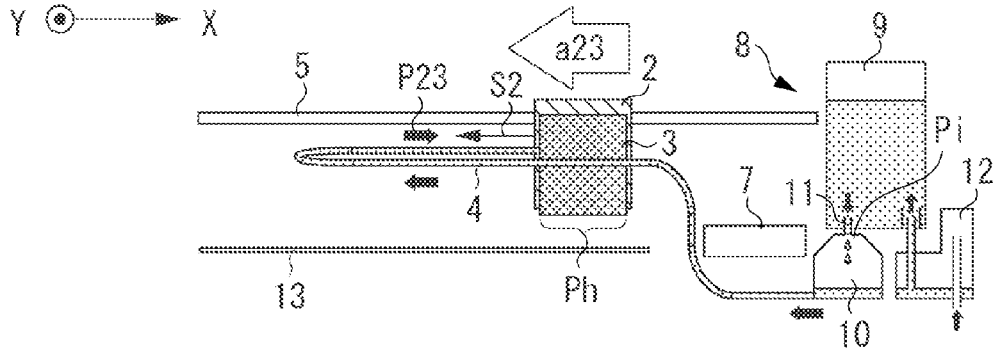
Figure 6E:
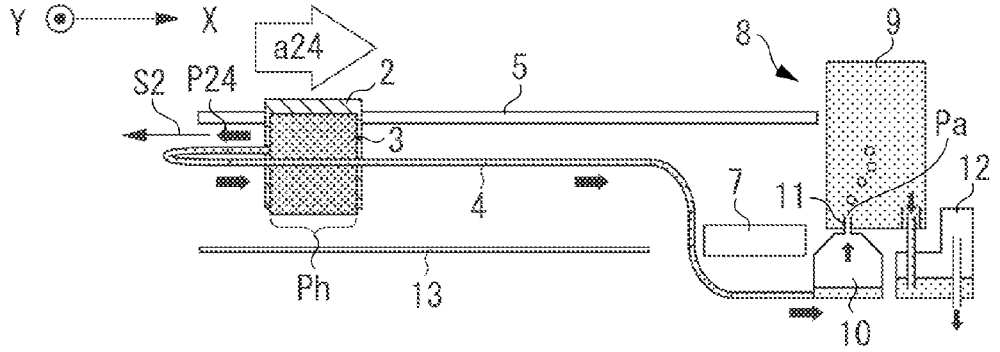

FIGS. 6A, 6B, 6C, 6D, and 6E are schematic diagrams illustrating operations performed when a sub-tank 10 is filled with ink by using dynamic pressure of the ink inside a supply tube 4 with a movement of a carriage 2 during unidirectional recording. One reciprocating movement of the carriage 2 is illustrated with FIGS. 6A to 6F in chronological order. Moreover, movement directions of the carriage 2 are indicated by arrows S1 and S2. Each of FIGS. 6A, 6B, and 6C illustrates a movement of the carriage 2 in the direction S1, whereas each of FIGS. 6D and 6E illustrates a movement of the carriage 2 in the direction S2.

A dynamic pressure P21 (expressed as P1 in the below relational expression) acts on the ink inside the supply tube 4 by an acceleration a21, and a dynamic pressure P22 (expressed as P2 in the relational expression) acts on the ink inside the supply tube 4 by an acceleration a22. Moreover, dynamic pressures P23 and P24 (respectively expressed as P2 and P1 in the blow relational expression) act on the ink inside the supply tube 4 by accelerations a23 and a24, respectively. In addition, a pressure resistance Pi to an ink movement inside a hollow tube 11, a pressure resistance Pa to an air movement inside the hollow tube 11, and a meniscus pressure-resistance Ph in a discharge port (not illustrated) of the recording head 3 are applied.

First, a movement of the air from the sub-tank 10 to the main tank 9 is described with reference to FIG. 6A.

The carriage 2 holding the recording head 3 is controlled by a control system (see FIG. 2) mounted on an inkjet recording apparatus main body such that the carriage 2 accelerates in the direction S1 with the acceleration a21. The supply tube 4 connected to the recording head 3 includes a section which moves by following a movement of the carriage 2. Herein, within the supply tube 4, the ink in the section, which moves by following the movement of the carriage 2, receives an inertial force generated by the acceleration a21. Since the supply tube 4 is arranged in parallel to the movement direction of the carriage 2, the ink is moved from the supply tube 4 to the sub-tank 10 by receiving the inertial force generated by the acceleration a21. The pressure generated at this time is the dynamic pressure P21 that acts on the ink inside the supply tube 4 with the acceleration a21.

Subsequently, the ink having received the dynamic pressure P21 is moved from the inside of the supply tube 4 to the sub-tank 10, thereby applying pressure to the inside of the sub-tank 10.

There is an air layer in an upper portion inside the sub-tank 10, and the air layer contacts the hollow tube 11. Herein, in a connection edge of the hollow tube 11 inside the main tank 9, the flow path resistance and the meniscus pressure-resistance are generated as the pressure resistance Pa to an air movement. That is, if the dynamic pressure P21 is higher than this pressure resistance Pa, the air is moved from the sub-tank 10 to the main tank 9. If the inside of the main tank 9 becomes pressurized by the air movement, the ink inside the main tank 9 is moved to a buffer chamber 12 via a communication tube 21. When the ink is moved into the buffer chamber 12, the air inside the buffer chamber 12 is pushed out via an atmosphere communication tube 22.

Moreover, the dynamic pressure P21 causes the ink to flow out from a reservoir of the recording head 3. The pressure generated at this time is adjusted by a pressure adjustment member 40. Since there is a limit that the pressure adjustment member 40 can adjust the amount of fluctuations, the dynamic pressure P21 may be desirably controlled to be lower than the meniscus pressure-resistance Ph in the discharge port of the recording head 3. Such control can prevent an inflow of the air from the discharge port of the recording head 3 to the inside of the recording head 3.

That is, the acceleration a21 is applied such that the dynamic pressure P21 (expressed as P1 in the below relational expression) of the ink inside the supply tube 4 becomes higher than the pressure resistance Pa to the air movement of the hollow tube 11 (P1>Pa). The application of such the acceleration a21 enables the air to be moved from the sub-tank 10 to the main tank 9. Moreover, if the acceleration a21 is set such that the dynamic pressure P21 is lower than the meniscus pressure-resistance Ph in the discharge port of the recording head 3 (see Expression (1)), the inflow of the air from the discharge port can be prevented.

$$Ph > P1 > Pa \qquad \text{Expression (1)}$$

FIG. 6B illustrates a state in which the carriage 2 reaches a predetermined speed (e.g., 25 inches/second) from the state illustrated in FIG. 6A, and moves at a constant speed. During the movement at the constant speed, the pressure is not changed by the movement of the carriage 2, and the ink is not moved by the change of the dynamic pressure. In the state illustrated in FIG. 6B, ink of the amount corresponding to the amount of ink discharged from the recording head 3 by executing the recording operation is only moved from the main tank 9 to the sub-tank 10. An operation for pulling the air or ink may be performed, in response to states of the buffer chamber 12 and the communication tube 21, depending on negative pressure inside the main tank 9. Accordingly, the ink can continue to be supplied, and the recording operation is performed in the direction S1 according to a recording signal.

Next, a movement of the ink from the main tank 9 to the sub-tank 10 is described with reference to FIG. 6C. In the predetermined section as illustrated in FIG. 6B, the carriage 2 is moved in the direction S1 at the constant speed for the recording operation. Subsequently, the carriage 2 holding the recording head 3 is controlled by the control system (see FIG. 2) mounted on the recording apparatus main body such that the carriage 2 decelerates with a minus acceleration a22.

In the deceleration section, the ink inside the supply tube 4 receives an inertial force generated by the minus acceleration a22. Since the supply tube 4 is arranged in parallel to the movement direction of the carriage 2, the ink having received the inertial force is moved from the supply tube 4 toward a direction of the recording head 3. The pressure generated at this time is the dynamic pressure P22 to be applied to the ink inside the supply tube 4 by the acceleration a22.

The ink having received the dynamic pressure P22 is moved from the supply tube 4 to the recording head 3, and this movement reduces the pressure inside the sub-tank 10.

In the hollow tube 11, the flow path resistance and the meniscus pressure-resistance are generated as the pressure resistance Pi to an ink movement. Accordingly, when the dynamic pressure P22 becomes higher than this pressure resistance Pi, the ink is moved from the main tank 9 to the sub-tank 10. Herein, the inside of the main tank 9 is negatively pressurized. Consequently, if there is ink inside the communication tube 21 and the buffer chamber 12 as illustrated in FIG. 6C, the ink inside the buffer chamber 12 is pulled into the main tank 9 via the communication tube 21. On the other hand, if there is not ink inside the communication tube 21 or the buffer chamber 12, the air is pulled inside the main tank 9 via the atmosphere communication tube 22, the buffer chamber 12, and the communication tube 21.

Moreover, the ink moved to the recording head 3 by the dynamic pressure P22 flows into the reservoir inside the recording head 3. The pressure generated at this time is adjusted by the pressure adjustment member 40. Since there is a limit that the pressure adjustment member 40 can adjust the amount of fluctuations, the dynamic pressure P22 may be desirably controlled to be lower than the meniscus pressure-resistance Ph in the discharge port of the recording head 3. Such control can prevent leakage of the ink from the discharge port of the recording head 3.

That is, the acceleration a22 is applied such that the dynamic pressure P22 (expressed as P2 in the relational expression below) of the ink inside the supply tube 4 becomes higher than the pressure resistance Pi to the ink movement of the hollow tube 11 (P2>Pi). The application of the acceleration a22 enables the ink to be moved from the main tank 9 to the sub-tank 10. Moreover, if the acceleration a22 is set such that the dynamic pressure P22 is lower than the meniscus pressure-resistance Ph in the discharge port of the recording head 3 (see Expression (2)), leakage of the ink from the discharge port can be prevented.

$$Ph > P2 > Pi \qquad \text{Expression (2)}$$

When decelerating with the acceleration a22, the carriage 2 gradually reduces speed and becomes motionless. Then, the carriage 2 begins to move in the direction S2. FIG. 6D illustrates the state of acceleration of the carriage 2 in the direction S2. Herein, a direction of the acceleration a23 is the same as that of the acceleration a22, and the ink dynamic pressure P23 (expressed as P2 in the relational expression below) acts on the ink inside the tube. Since a pressure-resistance relation at this time satisfies the same relational expression as FIG. 6C, the ink is moved from the main tank 9 to the sub-tank 10 similar to the state illustrated in FIG. 6C.

Then, the carriage 2 decelerates with the acceleration a24 as illustrated in FIG. 6E. Herein, a direction of the acceleration a24 is the same as that of the acceleration a21, and the dynamic pressure P24 (expressed as P1 in the relational expression) acts on the ink inside the tube. At this time, a pressure-resistance relation satisfies the same relational expression as that of FIG. 6A. That is, the air is moved from the sub-tank 10 to the main tank 9 similar to the state illustrated in FIG. 6A.

Thus, the carriage 2 repeatedly performs reciprocating recording operations, so that the sub-tank 10 is filled with the ink by using the dynamic pressure in the acceleration and deceleration area, particularly illustrated in FIGS. 6C and 6D.

Figure 7A:
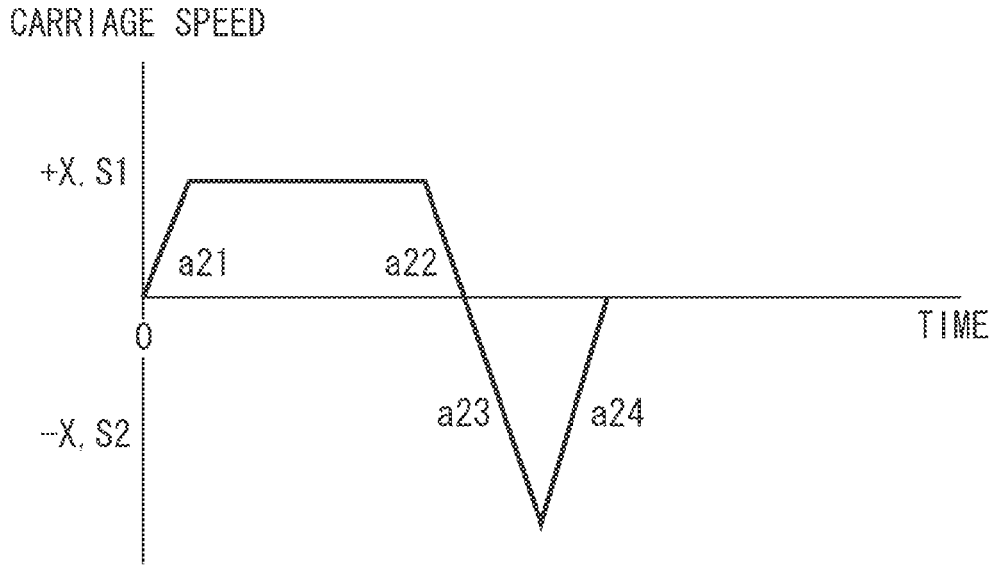
FIG. 7A is a schematic diagram illustrating an example of moving speed of a carriage during unidirectional recording according to the second exemplary embodiment.
Figure 7B:
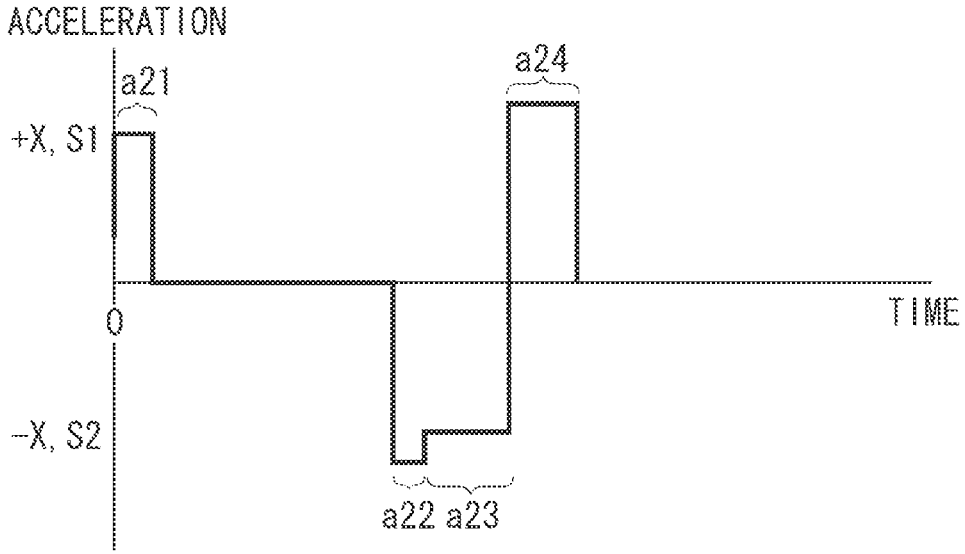
FIG. 7B is a schematic diagram illustrating an example of an acceleration profile during unidirectional recording.

FIGS. 7A and 7B respectively illustrate an example of carriage speed and an example of acceleration profile of the carriage 2 in an ink filling operation to the sub-tank 10 during unidirectional recording. Assume that the direction S1 (a plus X direction) in each of FIGS. 6A, 6B, and 6C is set to plus. The direction S2 (a minus X direction) in each of FIGS. 6D and 6E is set to minus. In FIG. 7A, a horizontal axis indicates time, and a vertical axis indicates moving speed of the carriage 2. In FIG. 7B, a horizontal axis indicates time, and a vertical axis indicates acceleration of the carriage 2. In FIG. 7A, the carriage 2 is motionless at time 0. The carriage 2 begins to move in the direction S1 at the acceleration a21 (e.g., 200 inches/second$^2$). After moving for a predetermined time, the carriage 2 reaches a predetermined speed (e.g., 25 inches/second) and moves at a constant speed. After moving further for a predetermined time, the carriage 2 decelerates with the acceleration a22 (e.g., 230 inches/second$^2$), and eventually becomes motionless. Subsequently, the carriage 2 begins to move in the direction S2 at the acceleration a23 (e.g., 200 inches/second$^2$). After moving for a predetermined time, the carriage 2 decelerates with the acceleration a24 (e.g., 230 inches/second$^2$), and eventually becomes motionless.

The present exemplary embodiment is not provided to restrict time for generating acceleration, and these drawings are merely examples. Moreover, in the description of the present exemplary embodiment, a recording operation is performed during a movement of the carriage 2 in the S1 direction, and a recording operation is not performed during a movement of the carriage 2 in the S2 direction. However, this is a merely example, and a movement direction of the carriage 2 with the recording operation is not limited thereto. In the description of the present exemplary embodiment, air is first moved and then ink is moved. However, such a case is merely one example. Alternatively, ink may be moved first, and then air may be moved.

The first and second exemplary embodiments have been described using a case where acceleration is constant. However, the acceleration may be variable. In an ink filling operation to a sub-tank according to a third exemplary embodiment is substantially the same as that described with FIGS. 4A through 4F, and the description thereof is omitted.

A dynamic pressure P31 (expressed as P1 in the below relational expression) acts on the ink inside a supply tube 4 by an acceleration a31, and a dynamic pressure P32 (expressed as P2 in the relational expression) acts on the ink inside the supply tube 4 by an acceleration a32. Moreover, dynamic pressures P33 and P34 (respectively expressed as P2 and P1 in the blow relational expression) act on the ink inside the supply tube 4 by accelerations a33 and a34, respectively.

Figure 8A:
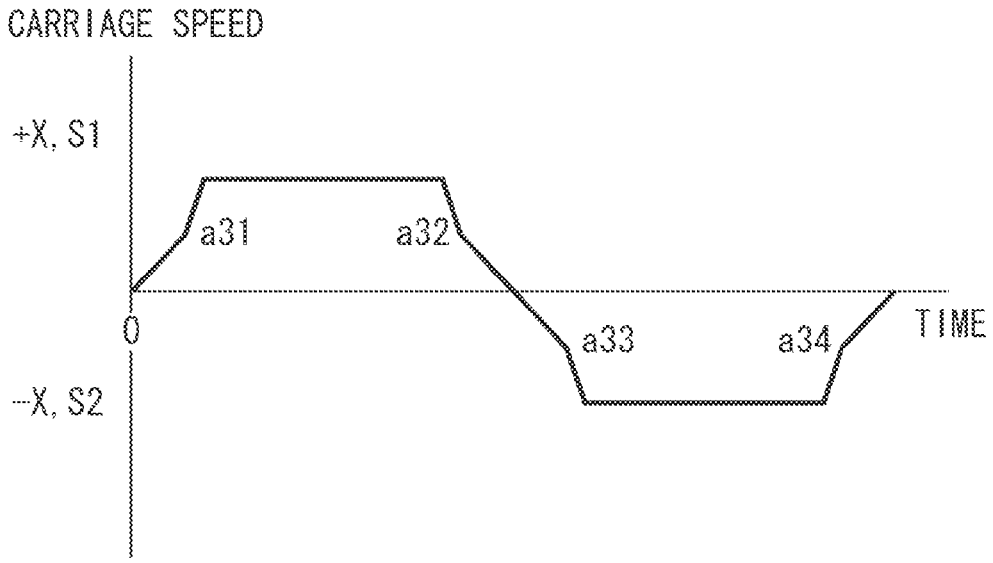
FIG. 8A is a schematic diagram illustrating another example of moving speed of a carriage when reciprocating scanning is performed during a recording operation according to a third exemplary embodiment.
Figure 8B:
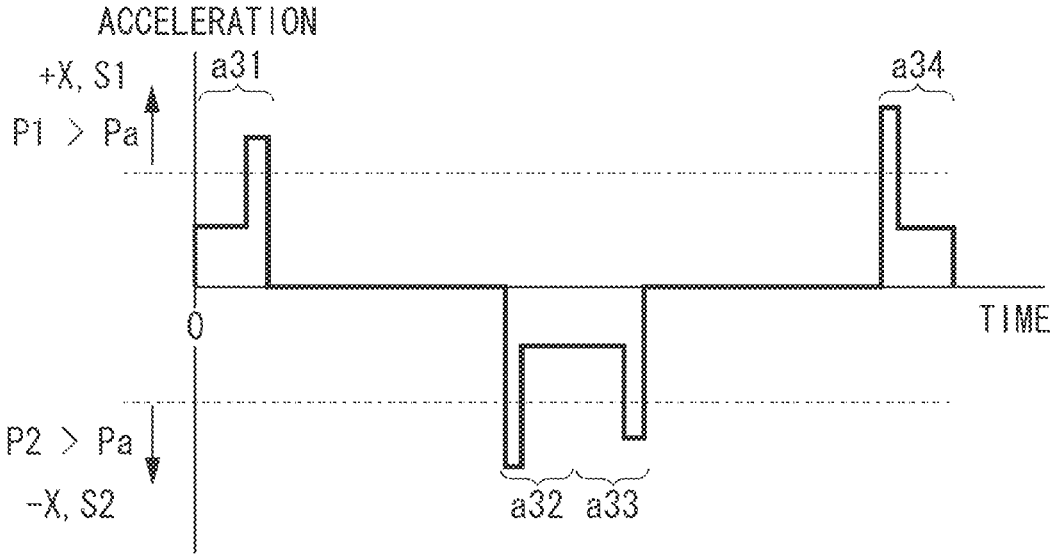
FIG. 8B is a schematic diagram illustrating another example of an acceleration profile when reciprocating scanning is performed during a recording operation.

FIGS. 8A and 8B respectively illustrate an example of carriage speed and an example of acceleration profile of a carriage 2 in an ink filling operation to a sub-tank 10 during bidirectional recording. Assume that a direction S1 (a plus X direction) in each of FIGS. 8A and 8B is set to plus, and a direction S2 (a minus X direction) in each of FIGS. 8A and 8B is set to minus. In FIG. 8A, a horizontal axis indicates time, and a vertical axis indicates moving speed of the carriage 2. In FIG. 8B, a horizontal axis indicates time, and a vertical axis indicates acceleration of the carriage 2. In FIG. 8A, the carriage 2 is motionless at time 0. The carriage 2 begins to move in the direction S1 by the acceleration a31, which fluctuates (e.g., fluctuation from 100 inches/second$^2$ to 200 inches/second$^2$). After moving for a predetermined time, the carriage 2 reaches a predetermined speed (e.g., 25 inches/second) and moves at a constant speed. After moving further for a predetermined time, the carriage 2 decelerates with the acceleration a32 which fluctuates (e.g., fluctuation from 230 inches/second$^2$ to 100 inches/second$^2$), and eventually becomes motionless. Then, the carriage 2 begins to move in the direction S2 at the acceleration a33, which fluctuates (e.g., fluctuation from 100 inches/second$^2$ to 200 inches/second$^2$). After moving for a predetermined time, the carriage 2 reaches a predetermined speed (e.g., 25 inches/second), and moves at a constant speed. After moving further for a predetermined time, the carriage 2 decelerates with the acceleration a34 which fluctuates (e.g., fluctuation from 230 inches/second$^2$ to 100 inches/second$^2$), and eventually becomes motionless.

In FIG. 8B, a chain line in a plus acceleration region indicates a lower limit of the acceleration that applies dynamic pressure used to move air from the sub-tank 10 to a main tank 9. A chain line in a minus acceleration region of the acceleration indicates an upper limit of the acceleration which applies dynamic pressure used to move ink from the main tank 9 to the sub-tank 10. As illustrated in FIG. 8B, one portion of each of the accelerations a31 and a34, which fluctuate, is acceleration applying dynamic pressure satisfying P1>Pa, desirably Ph>P1>Pa. Moreover, one portions of each of the accelerations a31 and a34, which fluctuate, is acceleration applying dynamic pressure satisfying P2>Pi, desirably Ph>P2>Pi. Such accelerations enable ink filling to the sub-tank 10. The fluctuation of the acceleration may not always need to have discontinuity.

The present exemplary embodiment is not provided to restrict time for generating acceleration, and these drawings are merely examples. Moreover, the present exemplary embodiment has been described using a case in which air is first moved and then ink is moved. However, such a case is merely one example. Alternatively, ink may be moved first, and then air may be moved. Moreover, although the present exemplary embodiment has been described using the recording operation as an example, the recording may not always need to be performed.

In each of the first through third exemplary embodiments, a sub-tank is filled with ink by controlling acceleration of a carriage during a recording operation. However, a sub-tank can be filled with ink by using an operation such as a scanning operation for cleaning a recording head and a sequence of registration adjustments, instead of the acceleration during the recording operation.

Moreover, when a main tank is replaced, and ink filling to the sub-tank is necessary during a non-recording operation in which a recording signal is not input, or when initial ink filling is necessary upon arrival of an inkjet recording apparatus, reciprocating scanning dedicated to filling the sub-tank with ink can be executed. An operation dedicated to filling the sub-tank during the non-recording operation can be performed as follows.

Figure 9A:
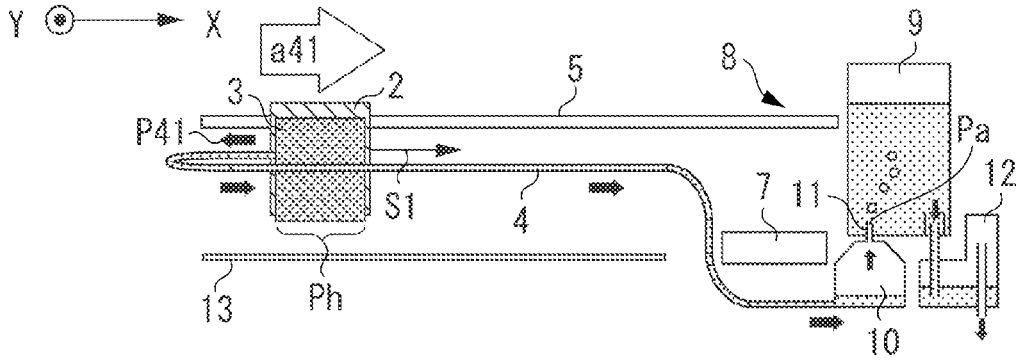
FIGS. 9A, 9B, 9C, and 9D are schematic diagrams illustrating a sequence of ink filling into a sub-tank using a movement of a carriage during non-recording according to a fourth exemplary embodiment.
Figure 9B:
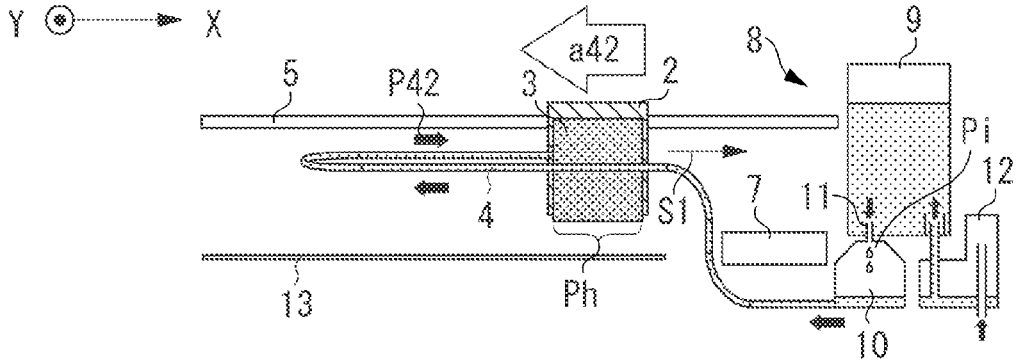
Figure 9C:
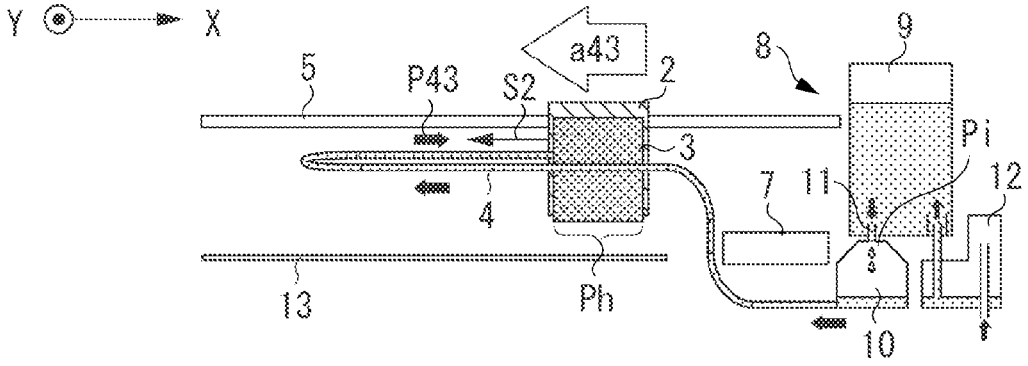
Figure 9D:
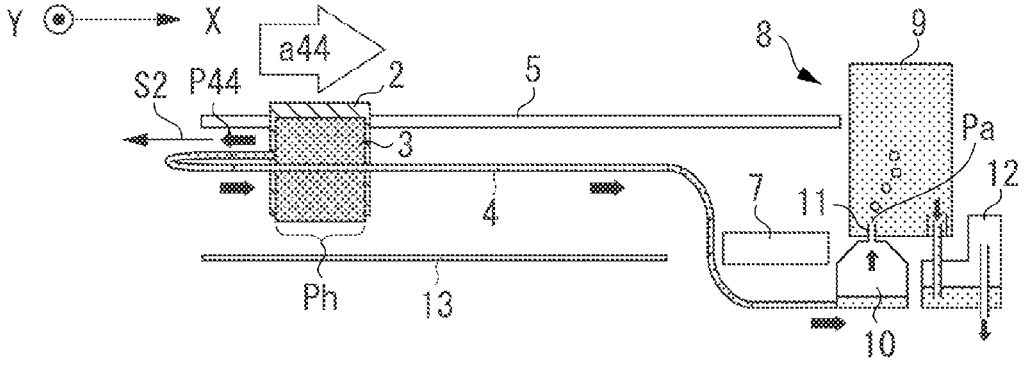

FIGS. 9A, 9B, 9C, and 9D are schematic diagrams illustrating operations performed when a sub-tank 10 is filled with ink by using dynamic pressure of the ink inside a supply tube 4 with a movement of a carriage 2 during non-recording according to a fourth exemplary embodiment. One reciprocating movement of the carriage 2 is illustrated with FIGS. 9A, 9B, 9C, and 9D in chronological order. Moreover, movement directions of the carriage 2 are indicated by arrows S1 and S2. That is, each of FIGS. 9A and 9B illustrates a movement of the carriage 2 in the direction S1, whereas each of FIGS. 9C and 9D illustrates a movement of the carriage 2 in the direction S2.

A dynamic pressure P41 (expressed as P1 in the below relational expression) acts on the ink inside the supply tube 4 by an acceleration a41, and a dynamic pressure P42 (expressed as P2 in the relational expression) acts on the ink inside the supply tube 4 by an acceleration a42. Moreover, dynamic pressures P43 and P44 (respectively expressed as P2 and P1 in the blow relational expression) act on the ink inside the supply tube 4 by accelerations a43 and a44, respectively. In addition, a pressure resistance Pi to an ink movement inside a hollow tube 11, a pressure resistance Pa to an air movement inside the hollow tube 11, and a meniscus pressure-resistance Ph in a discharge port (not illustrated) of a recording head 3 are applied.

First, the carriage 2 being motionless at time 0 begins to move in the direction S1 at the acceleration a41. Herein, air is moved from the sub-tank 10 to a main tank 9 (FIG. 9A). After reaching a predetermined carriage speed, the carriage 2 decelerates with the acceleration a42. Herein, ink is moved from the main tank 9 to the sub-tank 10 (FIG. 9B). The carriage 2 gradually reduces speed and becomes motionless. Then, the carriage 2 begins to move in the direction S2 at the acceleration a43. Herein, ink is moved from the main tank 9 to the sub-tank 10 (FIG. 9C). After reaching a predetermined carriage speed, the carriage 2 decelerates with the acceleration a44. Herein, air is moved from the sub-tank 10 to the main tank 9 (FIG. 9D).

The carriage 2 repeatedly performs the reciprocating recording operations, so that the sub-tank 10 is filled with the ink during the non-recording operation.

Figure 10A:
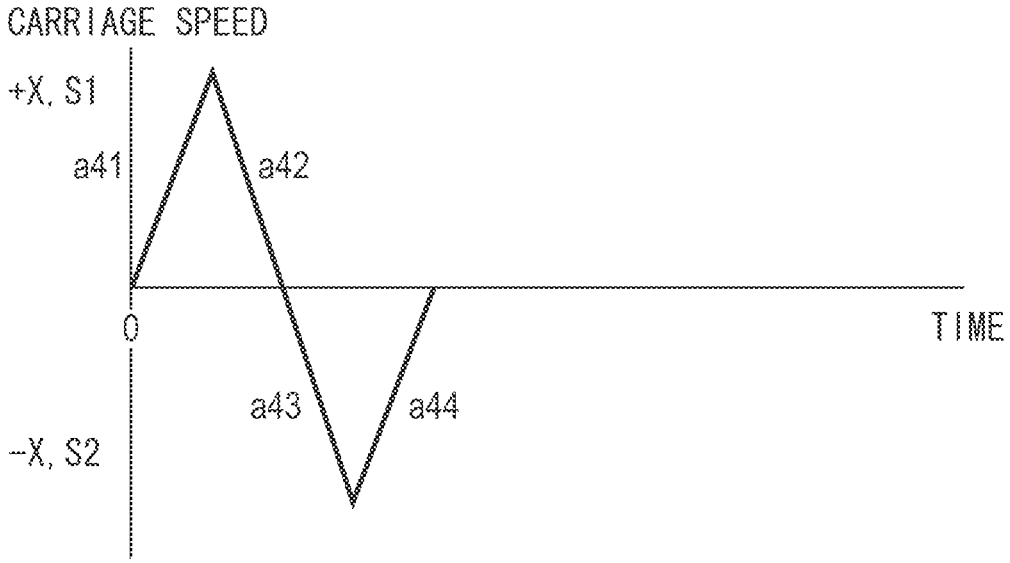
FIG. 10A is a schematic diagram illustrating an example of moving speed of a carriage during non-recording according to the fourth exemplary embodiment.
Figure 10B:
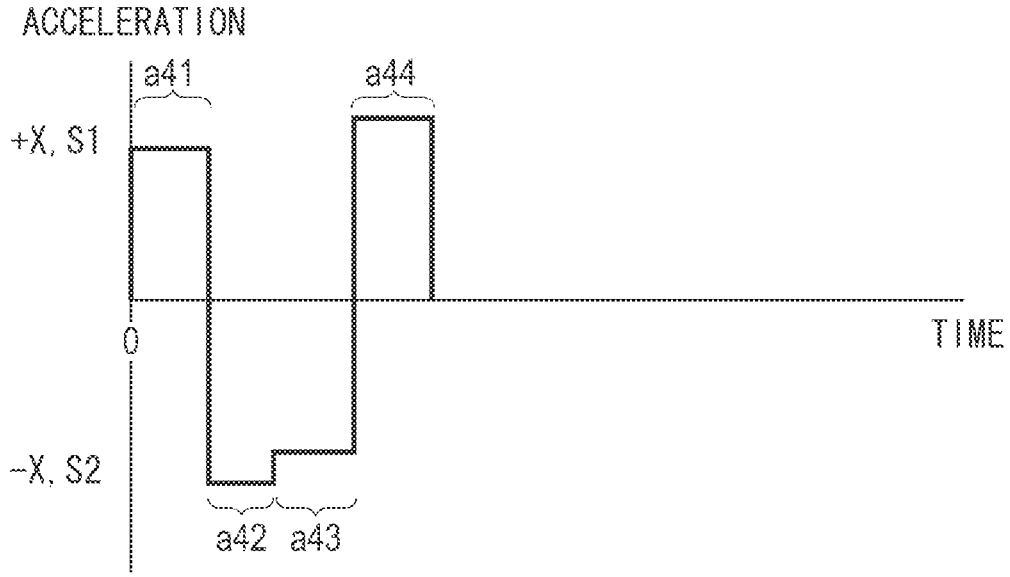
FIG. 10B is a schematic diagram illustrating an example of an acceleration profile during non-recording.

FIGS. 10A and 10B respectively illustrate an example of carriage speed and an example of acceleration profile of the carriage 2 in an ink filling operation to the sub-tank 10 during the non-recording operation. Assume that the direction S1 (a plus X direction) in each of FIGS. 9A and 9B is set to plus. The direction S2 (a minus X direction) in each of FIGS. 9C and 9D is set to minus. In FIG. 10A, a horizontal axis indicates time, and a vertical axis indicates moving speed of the carriage 2. In FIG. 10B, a horizontal axis indicates time, and a vertical axis indicates acceleration of the carriage 2. In FIG. 10A, the carriage 2 is motionless at time 0. The carriage 2 begins to move in the direction S1 at the acceleration a41 (e.g., 200 inches/second$^2$). After moving for a predetermined distance (time), the carriage 2 decelerates with the acceleration a42 (e.g., 230 inches/second$^2$), and eventually becomes motionless. Subsequently, the carriage 2 begins to move in the direction S2 at the acceleration a43 (e.g., 200 inches/second$^2$). After moving for a predetermined distance (time), the carriage 2 decelerates with the acceleration a44 (e.g., 230 inches/second$^2$), and eventually becomes motionless.

The dynamic pressure P41 from the acceleration a41 is controlled to satisfy P1>Pa described above, desirably Ph>P1>Pa, and the dynamic pressure P42 from the acceleration a42 is controlled to satisfy P2>Pi described above, desirably Ph>P2>Pi. Moreover, the dynamic pressure P43 from the acceleration a43 is controlled to satisfy P2>Pi, more desirably Ph>P2>Pi, and the dynamic pressure P44 from the acceleration a44 is controlled to satisfy P1>Pa, more desirably Ph>P1>Pa. Such control enables the sub-tank 10 to be filled with ink.

Like such a series of carriage speeds and the acceleration profile of the carriage 2, the carriage operation specialized in ink filling to the sub-tank 10 enables the sub-tank 10 to be efficiently filled with ink (in a short time).

In this operation, the carriage 2 is operated such that acceleration is always generated. However, a constant speed section may be arranged between acceleration and deceleration as illustrated in FIGS. 5A and 5B, FIGS. 7A and 7B, and FIGS. 8A and 8B. During the constant speed, ink is not discharged for recording, so that only an ink filling operation to the sub-tank 10 can be executed.

In each of the first through fourth exemplary embodiments, a sequence of ink filling into the sub-tank 10 from the main tank 9 is performed by only using changes in dynamic pressure applied by reciprocating scanning of the carriage 2. However, an inkjet recording apparatus can be controlled such that an ink filling operation is performed with a diaphragm valve in addition to the ink filling to the sub-tank by using the changes in the dynamic pressure. The ink filling operation using the diaphragm valve can be performed during non-recording, thereby shortening time for ink filling to the sub-tank.

Figure 11:
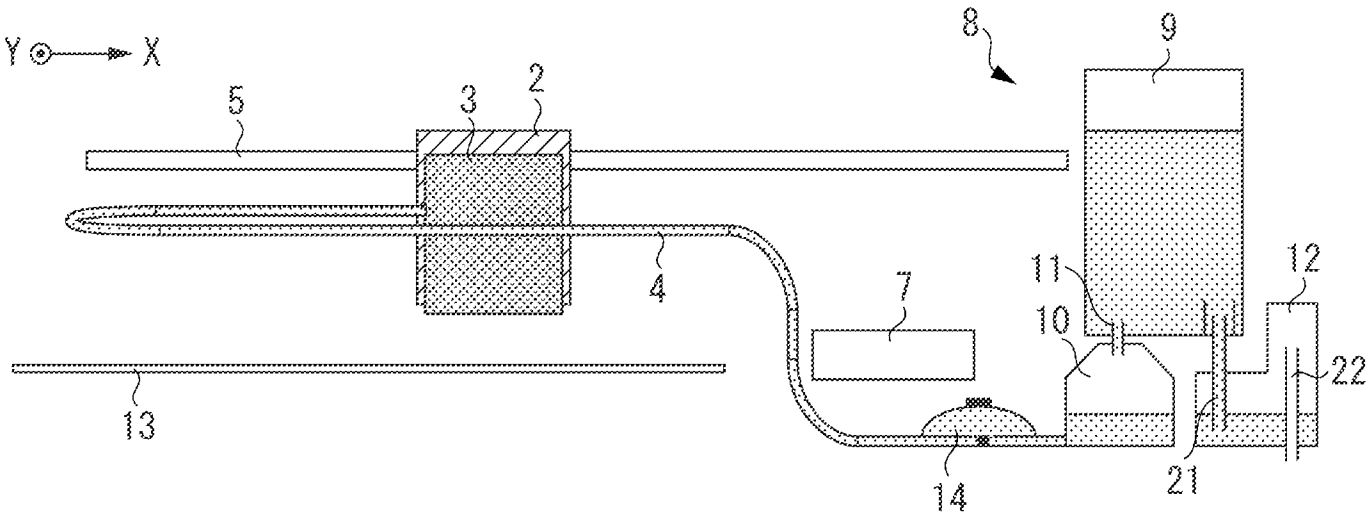
FIG. 11 is a schematic diagram illustrating a configuration of another ink supply system according to a fifth exemplary embodiment.
Figure 13:
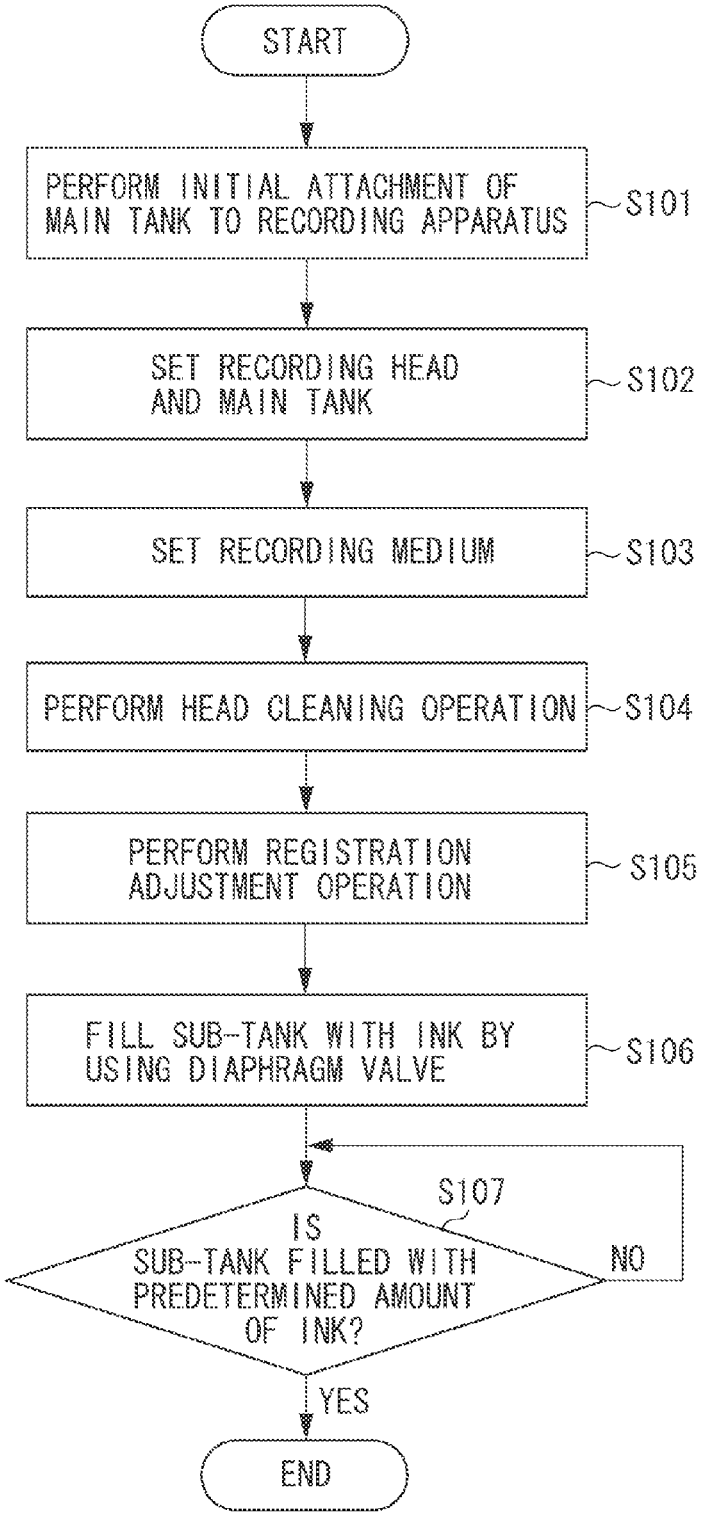
FIG. 13 is a flowchart illustrating an example of a sequence of ink filling to a sub-tank by another ink supply system according to the fifth exemplary embodiment.

FIG. 11 is schematic diagram illustrating a configuration of a recording apparatus main body according to a fifth exemplary embodiment. FIG. 13 is a flowchart illustrating ink filling to a sub-tank by the inkjet recording apparatus according to the fifth exemplary embodiment.

The recording apparatus main body illustrated in FIG. 11 is similar to that illustrated in FIG. 3 except for an arrangement of a diaphragm valve 14 made of a flexible material in a middle portion of a supply tube 4 for connecting a sub-tank 10 and a recording head 3. Hereinafter, the difference is only described.

Figure 12A:
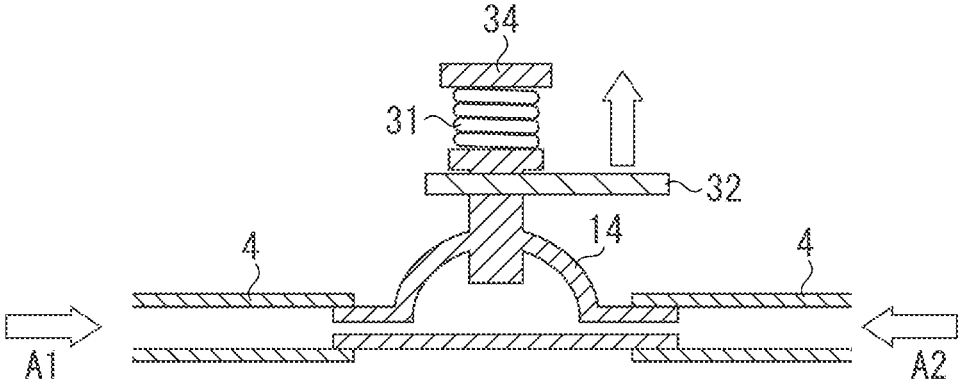
FIGS. 12A and 12B are cross sectional views illustrating an ink filling operation performed by using a diaphragm valve according to the fifth exemplary embodiment.
Figure 12B:
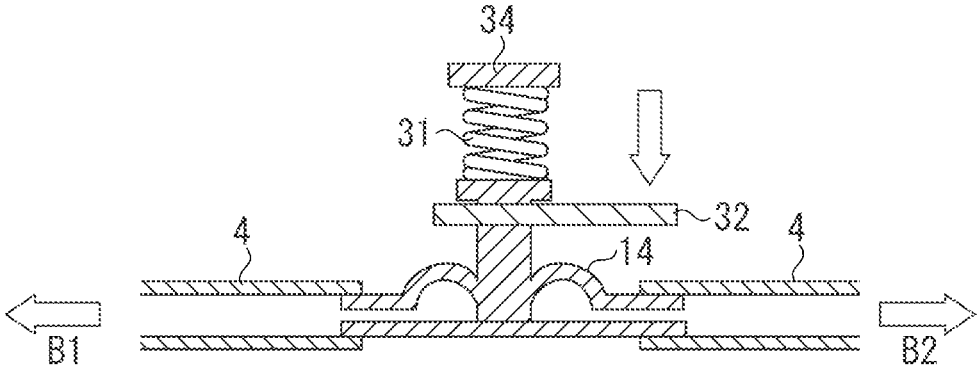

The diaphragm valve 14 switches between a closed state in which an ink flow path is closed by reducing volume of the diaphragm valve 14, and an open state in which the ink flow path is opened by increasing the volume of the diaphragm valve 14. FIGS. 12A and 12B are cross sectional views illustrating the supply of ink by the diaphragm valve 14.

The diaphragm valve 14 can change volume thereof using a spring 31, a lever 32, and a spring holding member 34. FIG. 12A illustrates a state in which a volume of the diaphragm valve 14 is maximal. Herein, an upward movement of the lever 32 as illustrated in FIG. 12A increases the volume of the diaphragm valve 14, so that the ink is supplied into the diaphragm valve 14 from the supply tube 4 in a direction A1 (on the side of the recording head 3) and a direction A2 (on the side of the sub-tank 10). FIG. 12B illustrates a state in which a volume of the diaphragm valve 14 is minimal. Herein, a downward movement of the lever 32 as illustrated in FIG. 12B reduces the volume of the diaphragm valve 14, so that the ink is supplied from the inside of the diaphragm valve 14 toward a direction B1 (a direction of the recording head 3) and a direction B2 (a direction of the sub-tank 10) of the supply tube 4. When the sub-tank 10 is full of ink, and there is no space in an upper portion thereof, ink returns to the main tank 9. However, if there is space, the pressure generated when the ink returns to the sub-tank 10 pushes the air in the space back to the main tank 9. Then, when the volume of the diaphragm valve 14 is increased again as illustrated in FIG. 12A, the ink is pulled back toward the direction A2 from the supply tube 4 connected to the sub-tank side. Consequently, the sub-tank 10 has negative pressure thereinside, and the ink in the main tank 9 is supplied into the sub-tank 10. The pressure adjustment member 40 cancels the fluctuations of pressure generated on the recording head side during each operation. Such operations are repeated to forcibly fill the sub-tank 10 with the ink.

When the main tank 9 is initially attached to the recording apparatus, or immediately after the main tank 9 is replaced with new one, the ink filling operation to the sub-tank 10 can be forcibly performed by using the diaphragm valve 14 in addition to the ink filling operation to the sub-tank 10 by using dynamic pressure of the ink inside the supply tube 4 of the present embodiment. The use of the diaphragm valve 14 for a forcible filling operation can shorten time for ink filling to the sub-tank 10.

For example, an ink filling operation performed when the main tank 9 is initially attached to the recording apparatus is executed according to the flowchart illustrated in FIG. 13.

In step S101, a user initially attaches the main tank 9 to the inkjet recording apparatus. In step S102, the user sets the recording head 3 and the main tank 9. Subsequently, in step S103, the user sets a recording medium. In step S104, the inkjet recording apparatus causes the recording head 3 to be capped, and performs a head cleaning operation. The inkjet recording apparatus performs a pressure reduction recovery operation, so that the main tank 9, the sub-tank 10, the supply tube 4, and the recording head 3 are liquidly communicated through ink. Herein, although the sub-tank 10 has ink thereinside, an amount of the ink is not sufficient. In step S105, the inkjet recording apparatus performs a registration adjustment operation or a cleaning operation with a carriage operation. This operation enables the ink to be moved from the main tank 9 to the sub-tank 10. In step S106, the inkjet recording apparatus performs the ink filling operation to the sub-tank 10 by using the diaphragm valve 14 such that the sub-tank 10 is filled with a sufficient amount of ink. In the ink filling operation using the diaphragm valve 14, since the sub-tank 10 is filled with a certain amount of ink by the time of step S104, a predetermined amount of ink can be filled into the sub-tank 10 in a short time. In step S107, the inkjet recording apparatus repeatedly performs the ink filling operations until the sub-tank 10 is filled with the predetermined amount of ink. When the sub-tank 10 if filled with the predetermined amount of ink, the initial attachment operation ends.

Each of the above-described exemplary embodiments are described using the large inkjet recording apparatus performing recording on a recording medium such as A1 size and A0 size. However, the exemplary embodiments are not limited thereto. The exemplary embodiments may be applied to a business printer performing recording on various types of recording media such as A3 size, and A4 size or smaller.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-100962 filed Apr. 26, 2012, which is hereby incorporated by reference herein in its entirety.

What is claimed is:

1. An inkjet recording apparatus comprising:

a recording head configured to discharge ink;

a carriage configured to move with the recording head mounted thereon;

a main tank configured to store ink;

a sub-tank configured to be supplied ink from the main tank;

a hollow tube that connects the main tank and the sub-tank;

a supply tube configured to supply ink from the sub-tank to the recording head, the supply tube moves by following a movement of the carriage; and a control unit configured to control acceleration of the carriage such that a dynamic pressure of ink inside the supply tube becomes greater than a pressure resistance to an ink movement and a pressure resistance to an air movement in the hollow tube.

2. The inkjet recording apparatus according to claim 1, wherein the control unit controls acceleration and deceleration of the carriage such that air is moved from the sub-tank to the main tank via the hollow tube and ink is moved from the main tank to the sub-tank.

3. The inkjet recording apparatus according to claim 1, wherein the hollow tube connects a lower portion of the main tank and an upper portion of the sub-tank in a direction of gravity.

4. The inkjet recording apparatus according to claim 1, wherein the supply tube includes a portion that moves by following a movement of the carriage.

5. The inkjet recording apparatus according to claim 4, further comprising a rail configured to support the carriage, wherein a portion of the supply tube is arranged parallel to the rail.

6. The inkjet recording apparatus according to claim 1, wherein the control unit controls acceleration of the carriage when an image is formed on a recording medium.

7. The inkjet recording apparatus according to claim 1, wherein the control unit controls acceleration of the carriage such that an ink dynamic pressure inside the supply tube becomes smaller than a meniscus pressure-resistance in the recording head.

8. The inkjet recording apparatus according to claim 1, wherein the sub-tank is hermetically closed except for portions connected to the supply tube and the hollow tube.

9. The inkjet recording apparatus according to claim 1, wherein the supply tube includes a diaphragm valve.

* * * * *